US006306336B1

(12) United States Patent
Hrezo et al.

(10) Patent No.: US 6,306,336 B1
(45) Date of Patent: Oct. 23, 2001

(54) APPARATUS AND METHOD OF CONTINUOUS SINTERING A WEB MATERIAL

(75) Inventors: Joseph R. Hrezo, Deltona; John F. Joyce, DeBary, both of FL (US)

(73) Assignee: USF Filtration and Separations Group, Inc., Timonium, MD (US)

( * ) Notice: Subject to any disclaimer, the term of this patent is extended or adjusted under 35 U.S.C. 154(b) by 0 days.

(21) Appl. No.: 09/437,803

(22) Filed: Nov. 10, 1999

(51) Int. Cl.[7] ..... C21D 11/10; C21D 1/74

(52) U.S. Cl. ..... 266/92; 266/110

(58) Field of Search ..... 266/110, 103, 266/99, 249, 78, 92; 419/3, 8, 23

(56) References Cited

U.S. PATENT DOCUMENTS

| | | | |
|---|---|---|---|
| 1,856,444 | 5/1932 | Sutton . | |
| 2,319,300 | 5/1943 | Cook . | |
| 2,838,420 | 6/1958 | Valente | 117/103 |
| 2,999,675 | 9/1961 | Erhardt, Jr. et al. . | |
| 3,476,840 | 11/1969 | Glassford | 264/25 |
| 3,810,735 | 5/1974 | Moser | 432/59 |
| 4,288,212 | 9/1981 | Vertegaal | 432/8 |
| 4,670,214 * | 6/1987 | Magnuson et al. | 419/3 |
| 4,765,598 * | 8/1988 | Magnuson et al. | 266/110 |
| 4,820,481 * | 4/1989 | Wolff et al. | 419/3 |

* cited by examiner

*Primary Examiner*—Scott Kastler
(74) *Attorney, Agent, or Firm*—Frijouf, Rust & Pyle, P.A.

(57) ABSTRACT

An apparatus is disclosed for continuously sintering a web material with a sintering furnace. An input refractory drive unrolls a refractory material from an input refractory roll and feeds the refractory material upon a furnace conveyor of the furnace. An output refractory drive removes the refractory material from the furnace and rolls the refractory material onto an output refractory roll. An input media drive unrolls the media material from an input media roll and feeds the media material onto the refractory material. An output media drive removes the media material from the refractory material and rolls the media material onto an output media roll. A hanging sensor senses the catenary hang of the media material from the input media roll. A control is connected to the hanging sensor for powering the input and output drives unrolling and rolling the materials in unison with one another and in unison with the movement of the furnace conveyor for maintaining a constant catenary hang of the media material from the input media roll to maintain a constant tension thereon.

15 Claims, 15 Drawing Sheets

APPARATUS AND METHOD OF CONTINUOUS SINTERING A WEB MATERIAL

BACKGROUND OF THE INVENTION

1. Field of the Invention

This invention relates to heat treating, and more particularly to an apparatus and method of continuously sintering a web material with a sintering furnace wherein the web material may be a matrix of fine metallic fibers forming a porous media.

2. Prior Art Statement

The prior art has known various types of devices for sintering a metallic or ceramic object or the like. The metallic or ceramic object is typically made from a matrix of elemental metallic or ceramic components. In the sintering process, the metallic or ceramic object is placed within a heated furnace elevated to a temperature sufficient to affix the elemental components of the object one another to form a unitary structure.

The elevated temperature is sufficient to affix the elemental metallic or ceramic components together either by melting the surface of the elemental metallic or ceramic components or by surface interaction but is insufficient to melt the individual elemental metallic or ceramic components. The heating of the metallic or ceramic object during the sintering process forms the metallic or ceramic object into a unitary object without loosing the shape of the object. Accordingly, the metallic or ceramic object could be formed of the elemental metallic or ceramic components into a desired shape and then sintered to set or fix the metallic or ceramic object into the final shape as a unitary member.

One specific area of sintering metallic or ceramic objects relates to the sintering of fibrous media. In a fibrous media, a multiplicity of fine fibers are randomly oriented into a sheet forming a web of fibrous media. The web of fibrous media was compressed and was sintered to form the desired fibrous media. The fibrous media may be used for various applications such as filtration of liquids or gases or may be used as a substrate such as a catalyst carrier, a battery plate or the like.

The fibrous media was processed by stacking a plurality of sheets of fibrous media in order to economically sinter the fibrous media. The fibrous media was prepared by stacking a plurality of sheets of fibrous media with a plurality of sheets of refractory material interleaved between the sheets of the fibrous media. A weight was placed upon the top of the stack of the plurality of sheets of fibrous media and the refractory material to compress the sheets of the fibrous media into a desired thickness.

The sintering of fibrous media was accomplished by the prior art in two distinct processes. In the first sintering process, the stack of the fibrous media and the refractory material were sintered in a vacuum furnace having a desired sintering atmosphere. In the second sintering process, the stack of the fibrous media and the refractory material were sintered on a conveyor passing through a furnace having a desired sintering atmosphere.

In the first sintering process, the stack of the fibrous media and the refractory material were placed in a vacuum furnace and the furnace was evacuated. Thereafter, the sintering atmosphere was introduced into the furnace and the furnace was increased to the desired sintering temperature. After the appropriate time for sintering of the fibrous media, the furnace was allowed to cool and the sintering atmosphere was removed from the furnace and the stack of fibrous material and the refractory material was removed therefrom. The first sintering process was essentially a batch sintering process.

In the second sintering process, the stack of the fibrous media and the refractory material were placed on a continuous conveyor and passed through a heated furnace having the sintering atmosphere. The fibrous media and the refractory material were passed thorough an input zone of the sintering atmosphere prior to heating and were passed thorough an output zone of the sintering atmosphere subsequent to heating. Due to the time required for heating and cooling of the stack of the fibrous media and the refractory material, the continuous conveyor was moved slowly through the heated furnace. The second sintering process was essentially a continuous-batch sintering process.

Although the use of the continuous-batch sintering process of the furnace and continuous conveyor belt provided several advantages over the batch sintering process of the vacuum furnace, both of the batch and the continuous-batch sintering processes still had several disadvantages.

The first disadvantage of the batch and the continuous-batch sintering processes was the limitation of the physical size of the fibrous media. There was no provision in either the batch or the continuous-batch sintering processes for making fibrous media of substantially long lengths.

The second disadvantage of the batch and the continuous-batch sintering processes was the variations in the weight produced by the stack of sheets of fibrous media and the refractory material. Due to the weight of the refractory material interleaved between the sheets of fibrous media, the bottom sheet of the fibrous media was compressed by a weight greater than the weight applied to the top sheet of the fibrous media. This caused variation in the thickness of the sheets of the fibrous media.

A third disadvantage of the batch and the continuous-batch sintering processes was the time required for the stacking of sheets of fibrous media with the interleaved refractory material therebetween. Typically, this process was done by a hand operation thus adding to the overall cost of the fibrous material.

A fourth disadvantage of the batch and the continuous-batch sintering processes was the cost associated with the sintering process. The sintering process is expensive and representing a significant portion of the cost of sintered fibrous media. If the cost of sintered fibrous media could be reduced, the lower cost of the sintered fibrous media opens the opportunity for new uses of the sintered fibrous media. The superior performance of sintered fibrous media over other types of material would provide a substantial economic advantage if the cost of sintered fibrous media could be reduced by technological processes.

The use of continuous processing furnaces have been known to the prior art for various heating tasks. Continuous processing furnaces have been used for the annealing, drying, coating processes and the like.

U.S. Pat. No. 1,856,444 to Sutton discloses a combination of a wire annealing furnace including means for moving the work to be annealed relatively fast through the furnace. An endless feed wire extends through the furnace with a part of the feed wire being located inside the furnace and with a part of the feed wire being located outside of the furnace. The feed wire is adapted to remain stationary while the work wire is moving through the furnace during the annealing operation. The feed wire is attached to the work wire for threading the work wire through the furnace.

U.S. Pat. No. 2,319,300 to Cook discloses an apparatus for heat treating strip metal comprising a furnace chamber and a pair of rotatable pulleys within the furnace chamber. An endless imperforate metallic belt is mounted entirely within the furnace chamber. A second pair of rotatable pulleys within the furnace chamber mounts a second endless imperforate metallic belt located entirely within the furnace chamber. The pairs of pulleys are positioned and spaced that portions of the belts are mounted in opposed parallel relation to each other and are spaced apart sufficiently to receive a strip of metal therebetween with the opposite faces of the strip in contact with the opposed parallel portions of the endless belts.

U.S. Pat. No. 2,838,420 to Valente discloses a method of producing an impregnated web in which the impregnant is substantially uniformly distributed throughout the thickness of the web. The method comprises introducing into a porous web a volatile liquid vehicle in such quantity and containing an impregnant in low enough concentration that the vehicle is present in the web as a continuous liquid body throughout the thickness of the web and the impregnant is mobile within the web in response to forces established by drying the web. A gaseous drying medium is passed through the web in alternately opposite directions before and until the continuous liquid body is interrupted but the web is still wet with the vehicle and contains a substantial quantity thereof capable of being evaporated by a conventional drying process to immobilize the impregnant in the web. The web is further dried sufficiently to permit handling.

U.S. Pat. No. 2,999,675 to Erhardt, Jr., et al. teaches an apparatus for heat-treating a continuous length of work comprising a movable heater having a pair of opposed panels of a size at least equal to the width of the work with each panel carrying a plurality of heating elements facing the sides of an interposed length of work. The heater is mounted for movement from a first position with the panels on opposite sides of the work to a second position beyond one edge of the work. Fuel is supplied to the elements in either position of the heater. The heater assembly is retracted laterally from the first position to the second position upon the stopping of the work.

U.S. Pat. No. 3,476,840 to Glassford discloses synthetic resin shapes molded from a continuous sheet of thermoplastic synthetic resin material by feeding a continuous sheet of the resin into a furnace in which the sheet is heat softened into a pliable, moldable state and is incidentally caused to sag. The sagging portion of the sheet is supported by means of a narrow metal band traveling beneath the sheet in the same direction and at the same rate as the sheet. The metal band is maintained at a predetermined temperature whereby the physical contact between the softened sheet and the supporting band does not mar or discolor the surface of the sheet. The softened sheet is fed directly into a molding or forming means and cooled to form molded articles.

U.S. Pat. No. 3,810,735 to Moser teaches a fixing system for fixing fusible material such as electroscopic particles upon support material. The system includes at least one fuser member in the form of an endless belt in pressure contact with another fuser member and between which the support material is transported. The fusing belt member is provided with a heat barrier blanket and is coated with a release agent that will prevent offset of the particles being fused.

U.S. Pat. No. 4,288,212 to Vertegaal discloses a method and apparatus for fixing the binding agent of a dye-stuff to a printed web of material by means of heat applied to the web within a treatment or polymerization chamber. The treatment time of the web is increased by effecting a loop formation of the web upon a slowly moving belt traveling within the treatment chamber. The web is first introduced into the chamber and is heated. Thereafter, the loop formation takes place. Upon leaving the treatment chamber, the web is passed over a stationary, curved shape heated plate, which smooths the web.

Although the aforementioned patents have solved many of the various needs through the use of a continuous processing furnace, none of the aforementioned patents is suitable for continuously sintering a web material with a sintering furnace.

Accordingly, it is an object of the present invention to provide an improved apparatus and method of continuously sintering a web material with a sintering furnace which overcomes the aforementioned problems of the prior art and provides a significant advancement in the manufacture of sintered media.

Another object of this invention is to provide an improved apparatus and method of continuously sintering a web material with a sintering furnace which may accommodate web material of extended lengths.

Another object of this invention is to provide an improved apparatus and method of continuously sintering a web material with a sintering furnace wherein the apparatus may be used with delicate web material such as a matrix of fine metallic fibers.

Another object of this invention is to provide an improved apparatus and method of continuously sintering a web material with a sintering furnace wherein a single sheet of fibrous material may be sintered with meaningful, economical results.

Another object of this invention is to provide an improved apparatus and method of continuously sintering a web material with a sintering furnace which is able to be automated thereby eliminating the need to hand assemble the stack of sheets of fibrous media.

Another object of this invention is to provide an improved apparatus and method of continuously sintering a web material with a sintering furnace which is capable of producing fibrous media with more consistent characteristics then provided by the sintering furnaces of the prior art.

Another object of this invention is to provide an improved apparatus and method of continuously sintering a web material with a sintering furnace which sintered media in a faster and more than efficient manner as well as provides a more uniform sintered material.

Another object of this invention is to provide an improved apparatus and method of continuously sintering a web material with a sintering furnace which provides a uniform weight to the sintered material during the sintering process.

Another object of this invention is to provide an improved apparatus and method of continuously sintering a web material with a sintering furnace which provides sintered fibrous material at reduced cost.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an apparatus and a method for continuously sintering a web material with a sintering furnace. The sintering furnace has a furnace conveyor moving from a furnace input to a furnace output. The apparatus and method comprises an input refractory drive for unrolling a refractory material from an input refractory roll and feeding the refractory material upon the furnace conveyor in proximity to the furnace input of the furnace. An output refractory drive removes the refractory material from the furnace output of the furnace and rolls the refractory material onto an output refractory roll. An input media drive unrolls the media material from an input media roll and feeds the media material onto the refractory material. An output media drive removes the media material from the refractory material and rolls the media material onto an output media roll. A hanging sensor senses the catenary hang of the media material from the input media roll. A control is connected to the hanging sensor for powering the input drive for unrolling the media material in unison with the movement of the furnace conveyor and for maintaining a constant catenary hang of the media material from the input media roll.

In a more specific example of the invention, the furnace comprises an open furnace input and an open furnace output. The furnace conveyor comprises an endless belt conveyor disposed within the furnace and extending between the open furnace input and the open furnace output. Preferably, the furnace conveyor continuously moves from the furnace input to the furnace output.

In another example of the invention, the input refractory drive comprises an upper and a lower input refractory driver for unrolling an upper and a lower refractory material for engaging an upper and a lower surface of the media material, respectively. The output refractory drive comprises an upper and a lower output refractory driver for removing the upper and lower refractory materials from the media material and for rolling the upper and lower refractory materials onto an upper and a lower output refractory roll. The upper and lower input and output refractory drivers maintain a constant tension therebetween for maintaining a constant force on the upper and lower surfaces of the media material.

Preferably, the input and output media drives are located above the furnace conveyor in proximity to the furnace input and the furnace output. The hanging sensor senses the catenary hang of the media material between the input media roll and the refractory material. The hanging sensor is connected to the control for controlling the input media drive for maintaining a constant catenary hang of the media material between the input media roll and the refractory material for maintaining a constant tension thereon.

The apparatus may include an input load drive for unrolling a load material from an input load roll and for feeding the load material onto the upper refractory material for providing a load upon the media material. An output load drive removes the load material from the upper refractory material and for rolling the load material onto an output load roll.

The apparatus may include an input barrier drive for unrolling a barrier material from an input barrier roll and for feeding the barrier material onto furnace conveyor for providing a support to the lower refractory material. An output barrier drive removes the barrier material from the furnace conveyor and for rolling the barrier material onto an output barrier roll.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated that the conception and the specific embodiments disclosed may be readily utilized as a basis for modifying or designing other structures for carrying out the same purposes of the present invention. It also should be realized by those skilled in the art that such equivalent constructions do not depart from the spirit and scope of the invention as set forth in the appended claims.

BRIEF DESCRIPTION OF DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
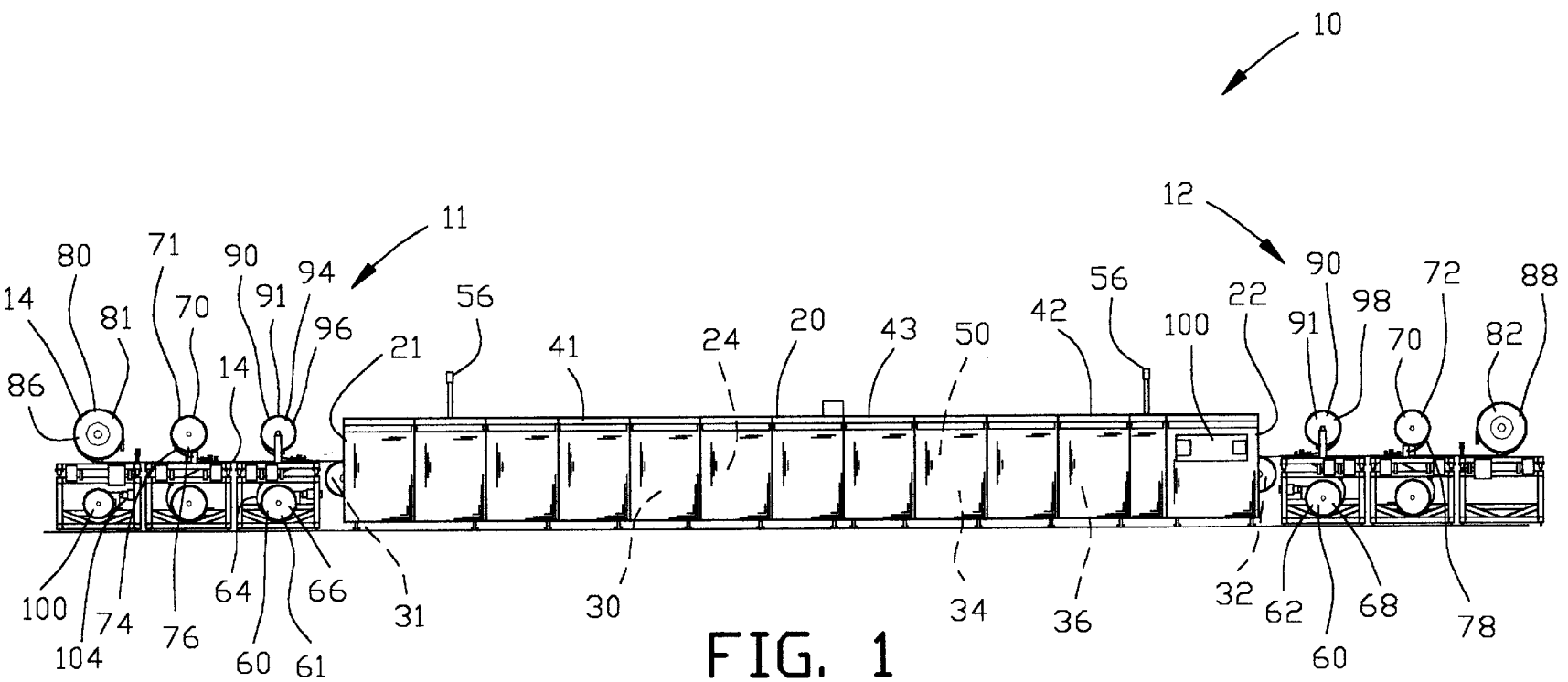
FIG. 1 is a side elevational view of an apparatus for continuously sintering a web material with a sintering furnace incorporating the present invention.
Figure 2:
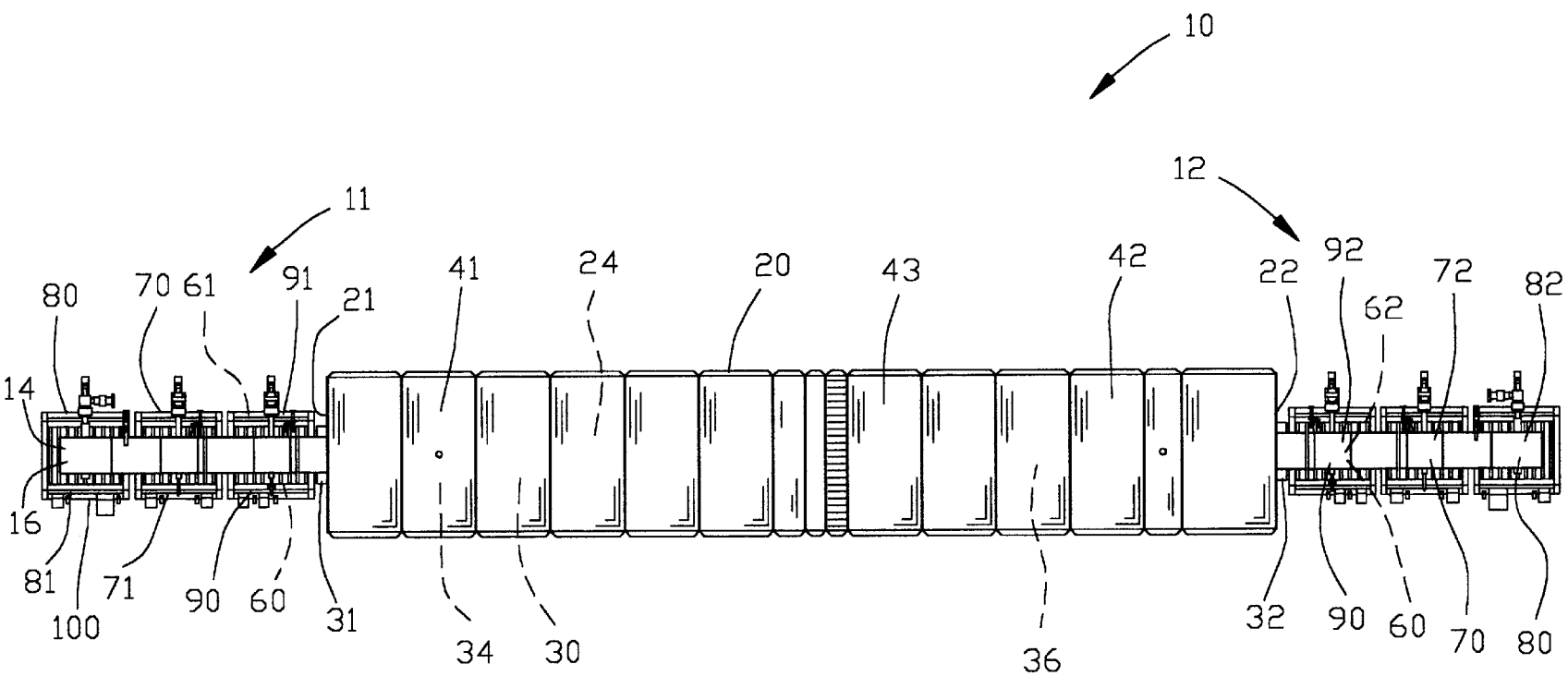
FIG. 2 is a top view of FIG. 1.

FIGS. 1 and 2 are side and top elevational views of an apparatus 10 incorporating the present invention. The apparatus 10 extends between an input portion 11 and an output portion 12 for continuously sintering a web material 14 with a sintering furnace 20. The sintering furnace 20 comprises an open furnace input 21 and an open furnace output 22. Preferably, the sintering furnace 20 comprises a tunnel 24 extending between the open furnace input 21 and open furnace output 22.

A furnace conveyor 30 comprises an input drum 31 and output drum 32 with an endless belt 34 disposed therebetween. The input drum 31 and the output drum 32 are located adjacent to the open furnace input 21 and the open furnace output 22 with endless belt 34 extending through the sintering furnace 20. The furnace conveyor 30 continuously moves from the open furnace input 21 to the open furnace output 22.

The sintering furnace 20 includes an input zone 41 and an output zone 42 with a central zone 43 dispose therebetween. The central zone 43 is raised to an elevated temperature suitable for sintering the selected web material 14. The input zone 41 is maintained at a lower temperature relative to the central zone 43 for providing a region of temperature transition from an ambient temperature external the sintering furnace 20 to the elevated temperature of the central zone 43. In a similar manner, the output zone 42 is maintained at a lower temperature relative to the central zone 43 for providing a region of temperature transition from the elevated temperature of the central zone 43 to the ambient temperature external the sintering furnace 20.

The sintering furnace 20 includes a sintering atmosphere shown generally as 50. Preferably the sintering atmosphere 50 is a reducing atmosphere for inhibiting oxidation of the web material 14. The sintering atmosphere permeates through the input zone 41, the output zone 42 and the central zone 43. Accordingly, the selected web material 14 resides within the sintering atmosphere in the input zone 41 and the output zone 42 during the temperature transition between the ambient temperature external the sintering furnace 20 and the elevated temperature within the central zone 43. The sintering furnace 20 may be provided with a stack 56 for burning excess gases of the sintering atmosphere during the sintering process. In the case when the web material 14 is an open matrix of stainless steel fibers 15, the web material 14 is sintered at approximately 1700 degrees Fahrenheit within a hydrogen atmosphere.

The endless belt 34 may be in the form of a wire mesh belt 34 defining a multiplicity of apertures 36. Preferably, the endless belt 34 is formed from a metallic material capable of maintaining mechanical strength through the elevated temperature of the central zone 43 without substantial mechanical defamation. The multiplicity of apertures 36 defined within the wire mesh belt 34 reduce the mass of the wire mesh belt 34 for enabling the wire mesh belt to be rapidly heated and cooled during the transitions between the ambient temperature external the sintering furnace 20 and the elevated temperature within the central zone 453. Furthermore, the multiplicity of apertures 36 defined within the wire mesh belt 34 allow heated gas to flow through the wire mesh belt 34 for heating the web material 14.

The apparatus 10 comprises a plurality of drives including a barrier drive 60, a refractory drive 70, a web drive 80, a load drive 90 and a backing drive 100. The input portion 11 of the apparatus 10 includes an input barrier drive 61, an input refractory drive 71, an input web drive 81, an input load drive 91 and a backing drive 100. The output portion 12 of the apparatus 10 includes an output barrier drive 62 an output refractory drive 72 an output web drive 82 and an output load drive 92.

The barrier drive 60 comprises the combination of the input barrier drive 61 and the output barrier drive 62. The input barrier drive 61 unrolls a barrier material 64 from an input barrier roll 66 and feeds the barrier material 64 onto the furnace conveyor 34. The output barrier drive 62 removes the barrier material 64 from the furnace conveyor 34 and rolls the barrier material 64 onto an output barrier roll 68. The barrier material 64 may be a metallic weaved mesh cloth or any other suitable material.

The refractory drive 70 comprises the combination of the input refractory drive 71 and the output refractory drive 72. The input refractory drive 71 unrolls a refractory material 74 from an input refractory roll 76 and feeds the refractory material 74 onto the furnace conveyor 34. The output refractory drive 72 removes the refractory material 74 from the furnace conveyor 34 and rolls the refractory material 74 onto an output refractory roll 78. The refractory material 74 may be a metallic wire mesh cloth or any other suitable material.

The web drive 80 comprises the combination of the input web drive 81 and the output web drive 82. The input web drive 81 unrolls a web material 14 and an optional backing material 16 from an input web roll 86. The optional backing material 16 is separated from the web material 14 and the web material 14 is feed onto the furnace conveyor 34. The output web drive 82 removes the web material 14 from the furnace conveyor 34 and rolls the web material 14 onto an output web roll 88. The web material may be an open matrix of metallic fibers 15.

The load drive 90 comprises the combination of the input load drive 91 and the output load drive 92. The input load drive 91 unrolls a load material 94 from an input load roll 96 and feeds the load material 94 onto the furnace conveyor 34. The output load drive 92 removes the load material 94 from the furnace conveyor 34 and rolls the load material 94 onto an output load roll 98. The load material 94 may be a heavy weaved wire mesh or any other suitable material.

The backing drive 100 rolls the backing material 16 separated from the web material 14 onto a backing roll 108. The optional backing material 16 may be a paper or a flexible polymeric material or any other suitable material.

The apparatus 10 is provided with a control 110 for controlling the various operations of the apparatus 10. Preferably, the control 110 receives inputs from sensors located about the apparatus 10 for controlling the sintering process. The plurality of drives 60, 70, 80, 90 and 100 are connected to the control 110 for controlling the movement of the web material 14 through the sintering furnace 20 as will be described in greater detail hereinafter.

Figure 3:
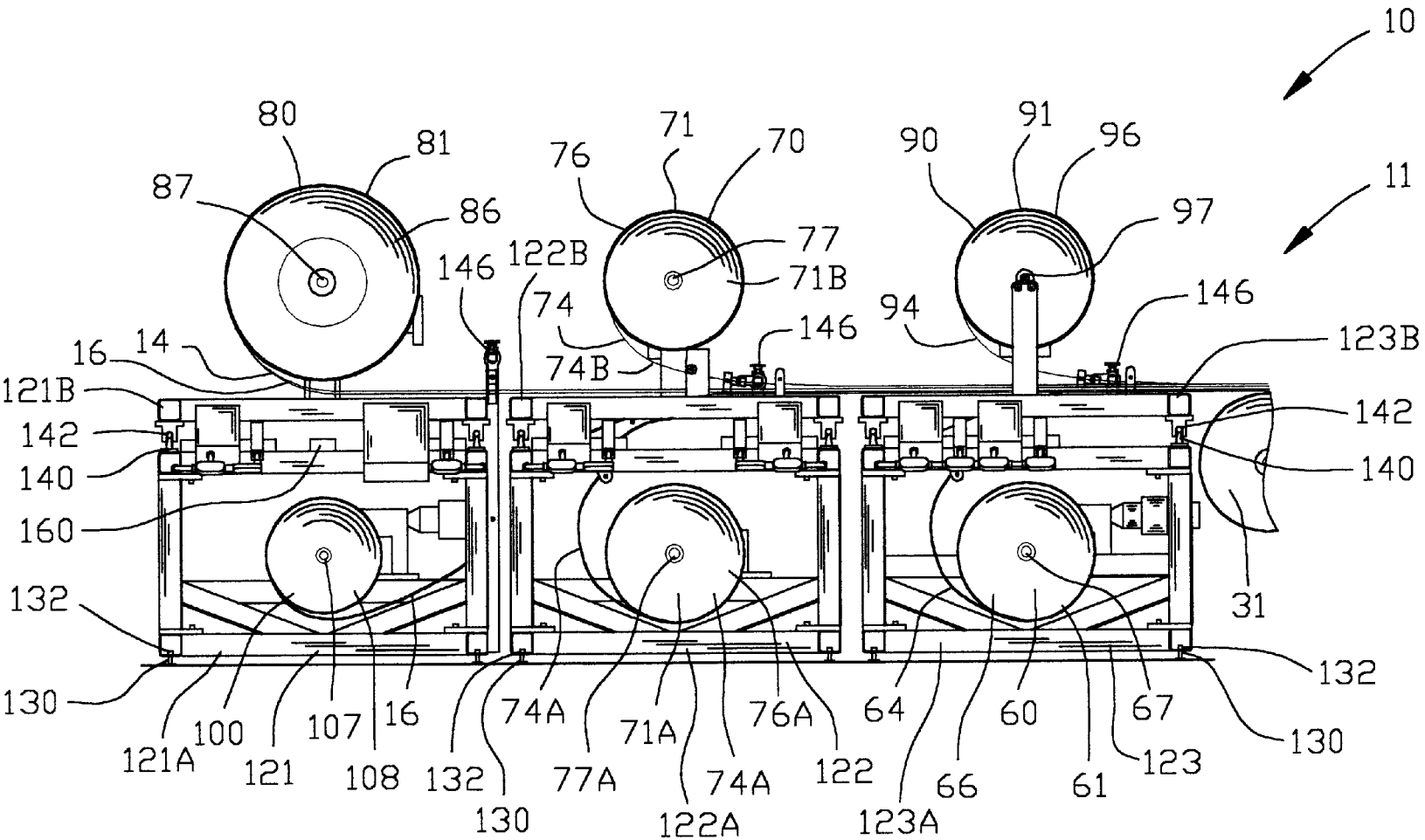
FIG. 3 is an enlarged view of an input portion of FIG. 1.
Figure 4:
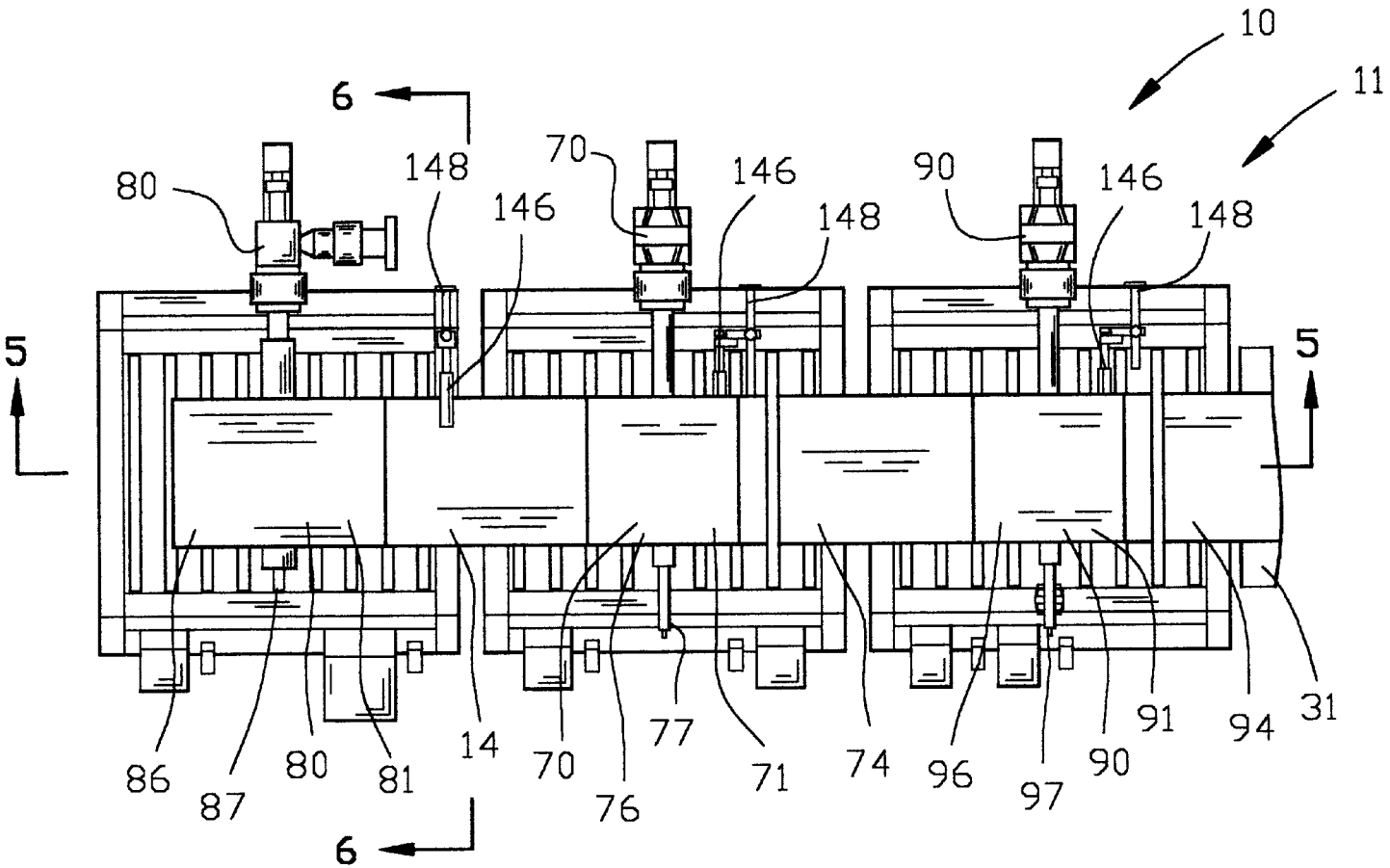
FIG. 4 is a top view of FIG. 3.

FIGS. 3 and 4 are enlarged side and top views of the input portion 11 of the apparatus 10 shown in FIGS. 1 and 2. The input portion 11 comprises a plurality of frames 121–123 located adjacent to the input drum 31 of the furnace conveyor 30. Each of the frames 121–123 are substantially identical to one another and are located in a serial arrangement relative to the input drum 31 of the furnace conveyor 30. Each of the frames 121–123 comprise a lower frame element 121A–123A and an upper frame element 121B–123B.

Each of the frames 121–123 comprise a first rail 130 cooperating with a first slide 132 for enabling each of the lower frame elements 121A–123A to independently laterally move in direction along the axes 67, 77A, and 107 of the drives 60, 70A, and 100. Each of the frames 121–123 comprise a second rail 140 cooperating with a second slide 142 for enabling each of the upper frame elementS 121B–123B to independently laterally move in direction along the axes 77, 87 and 97 of the drives 70, 80 and 90 relative to the lower frame elements 121A–123A.

Figure 5:
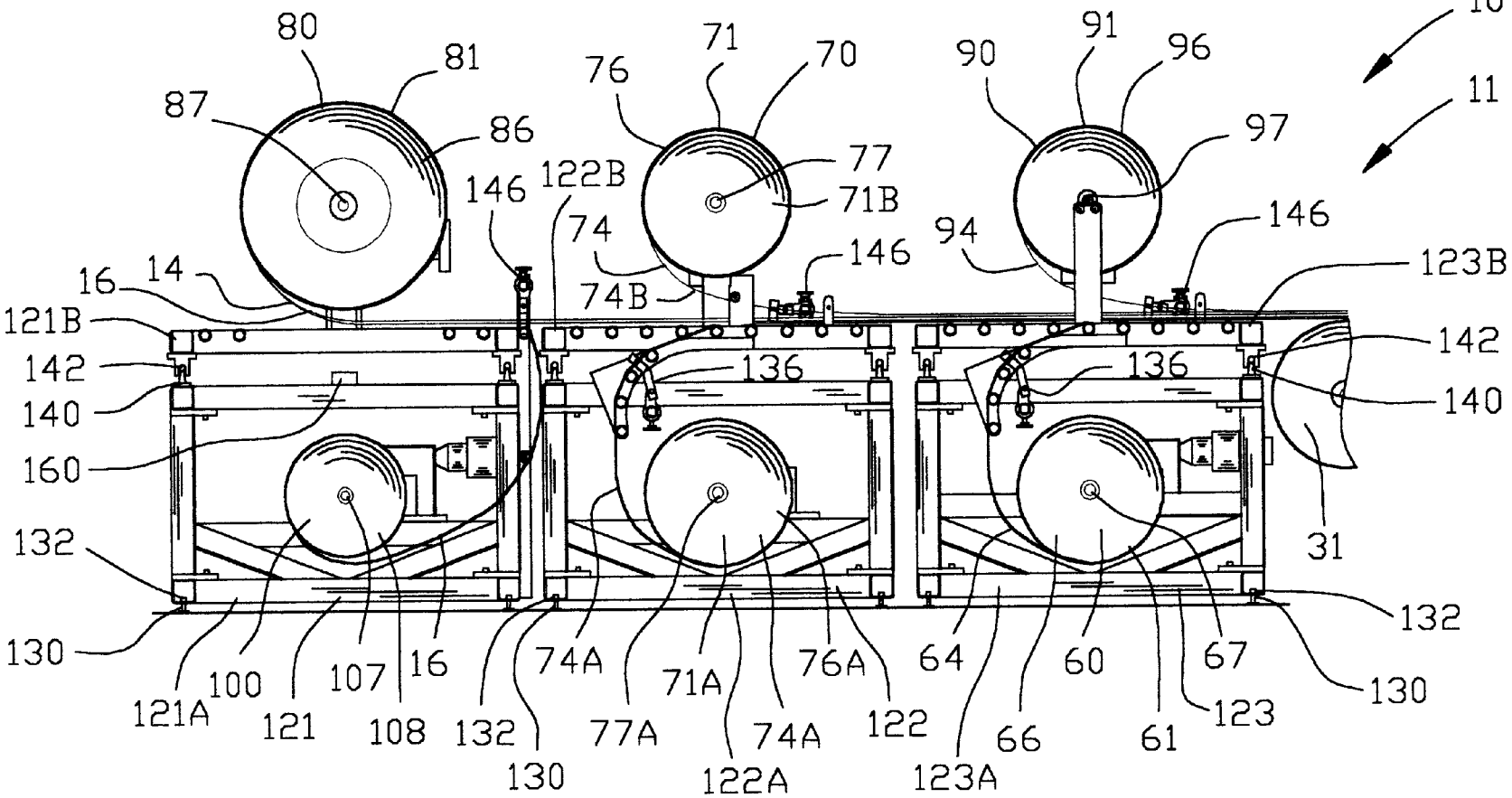
FIG. 5 is a sectional view along line 5—5 in FIG. 4.

FIG. 5 is a sectional view along line 5—5 in FIG. 4. The input barrier drive 61 is mounted to the lower frame element 123A for unrolling the barrier material 64 from the input barrier roll 66 onto the furnace conveyor 34.

The input refractory drive 71 comprises a lower input refractory drive 71A and an upper refractory drive 71B. The lower input refractory drive 71A is mounted on the lower frame element 122A whereas the upper refractory drive 71B is mounted on the upper frame element 122B.

The lower and upper input refractory drives 71A and 71B unroll a lower refractory material 74A from a lower input refractory roll 76A and unroll an upper refractory material 74B from an upper input refractory roll 76B onto the furnace conveyor 34.

The input web drive 81 is mounted on the upper frame element 121B. The backing drive 100 is mounted on the lower frame element 121A. The input web drive 81 unrolls the web material 14 and the backing material 16 from the input web roll 86. The backing material 16 is separated from the web material 14 enabling the web material 14 to be feed between the lower and upper refractory materials 74A and 74B and onto the furnace conveyor 34. The backing drive 100 rolls the backing material 16 onto a backing roll 108.

The input load drive 91 is mounted on the upper frame element 123B. The input load drive 91 unrolls a load material 94 from the input load roll 96 and feeds the load material 94 onto the upper refractory materials 74A on the furnace conveyor 34.

Figure 6:
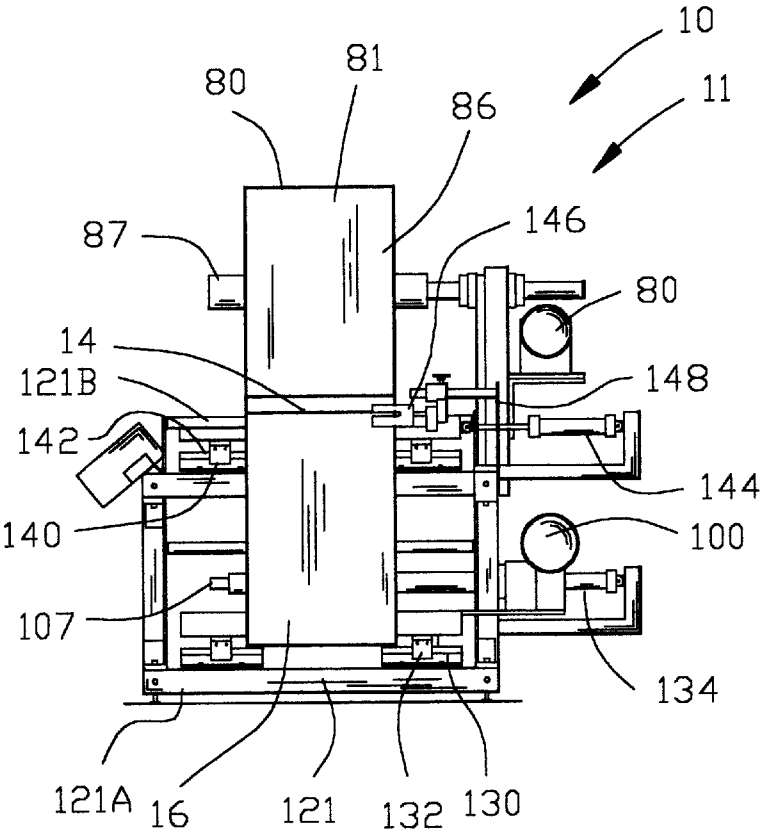
FIG. 6 is a sectional view along line 6—6 in FIG. 4.

FIG. 6 is a sectional view along line 6—6 in FIG. 4. Each of the lower frame elements 121A–123A include a first linear actuator 134 for laterally moving the drives 60, 70A, and 100 along the first rail 130 and the first slide 132 in direction along the axes 67, 77A, and 107. In a similar manner, each of the upper frame elements 121B–123B include a second linear actuator 144 for laterally moving the drives 70B, 80 and 90 along the second rail 140 and the second slide 142 in direction along the axes 77B, 87 and 97.

Each of the lower frame elements 121A–123A includes a first lateral sensor 136 for sensing the lateral position of the barrier material 64 and the lower refractory material 74A. The first lateral sensors 136 are connected to the first linear actuators 134 through the control 110 for actuating the first linear actuator 134.

Each of the upper frame elements 121B–123B includes a second lateral sensor 146 for sensing the lateral position of the web material 14, the upper refractory material 74B and the load material 94. The second lateral sensors 146 are connected to the second linear actuators 144 through the control 110 for actuating the second linear actuator 144.

Figure 7:
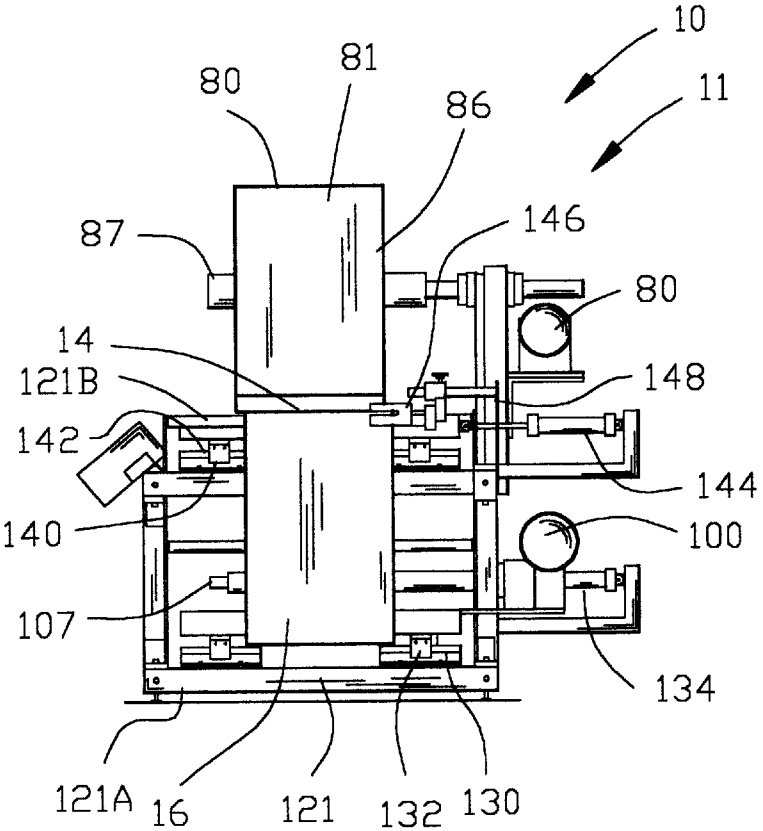
FIG. 7 is a view similar to FIG. 6 with a drive being shown in a misaligned position.

FIG. 7 is a view similar to FIG. 6 with the web drive 80 being shown in a misaligned position. When the second lateral sensor 146 senses the misalignment of the web material 14, the second lateral sensor 146 provides an input to the control 110 for actuating the respective second linear actuator 144 for moving the web drive 80 into proper alignment as shown in FIG. 6.

Figure 8:
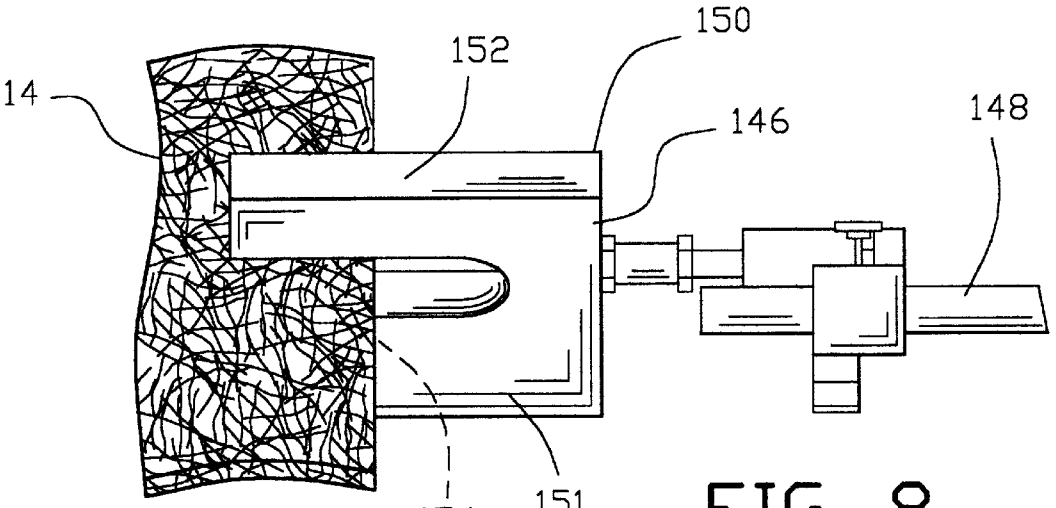
FIG. 8 is an enlarged view of a lateral positioning sensor shown in FIG. 6.
Figure 9:
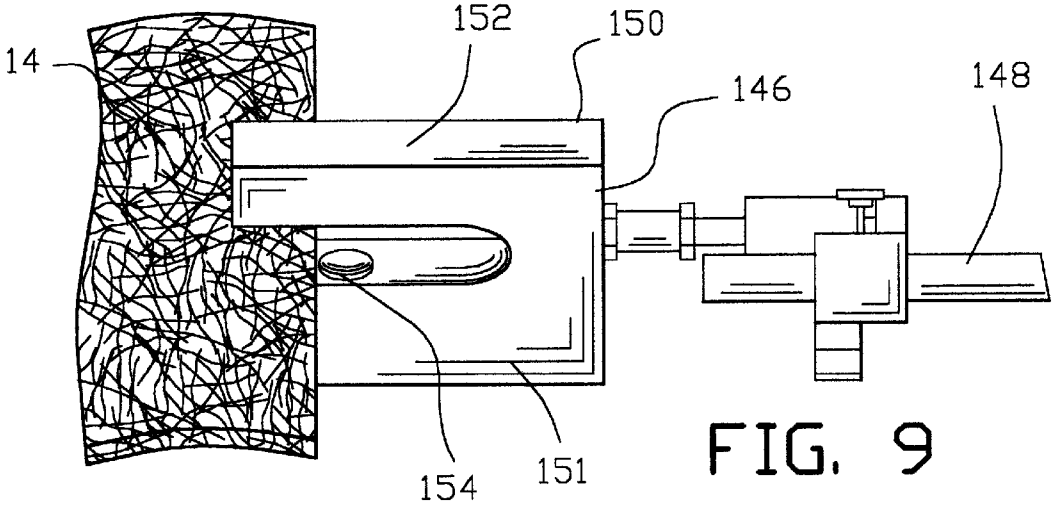
FIG. 9 is an enlarged view of the lateral positioning sensor shown in FIG. 7.

FIGS. 8 and 9 are enlarged views of the second lateral sensor 146 shown in FIGS. 6 and 7, respectively. The second lateral sensor 146 is mounted by an adjustable mount 148 to the upper frame element 121B. The second lateral sensor 146 comprises a fork 150 having a first and a second finger 151 and 152. A sensor element 154 is positioned on the finger 151 for sensing the lateral position of the web material 14 therebetween. The web material 14 is passed between the first and second fingers 151 and 152 of the fork 150.

FIG. 8 illustrates the web material 14 disposed adjacent to the sensor element 154 sensing the proper alignment of the web material 14 on the apparatus 10. The sensor element 154 may be of any suitable type such as an optical sensor, a capacitive sensor or an inductive sensor.

FIG. 9 illustrates the web material 14 disposed in a misaligned positioned relative to the sensor element 154. The misaligned position of the web material 14 is constantly being corrected to insure proper alignment of the web material 14.

It should be understood that each of the input drives including the barrier drive 60, the refractory drive 70, the web drive 80, the load drive 90 and the backing drive 100 are provided with a lateral sensor for insuring proper alignment of the materials 64, 74, 84, 94 and 104.

Figure 10:
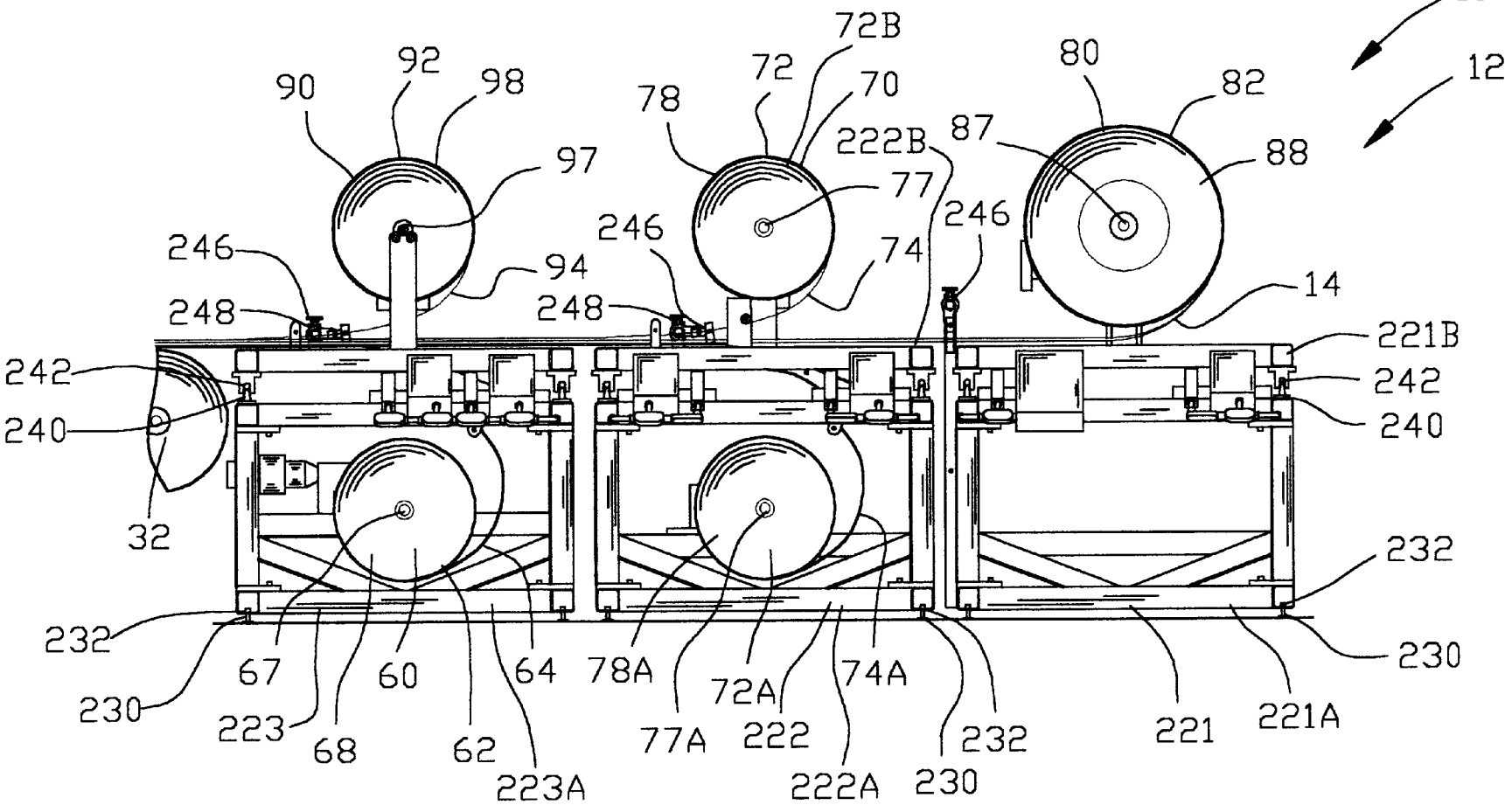
FIG. 10 is an enlarged view of an output portion of FIG. 1.
Figure 11:
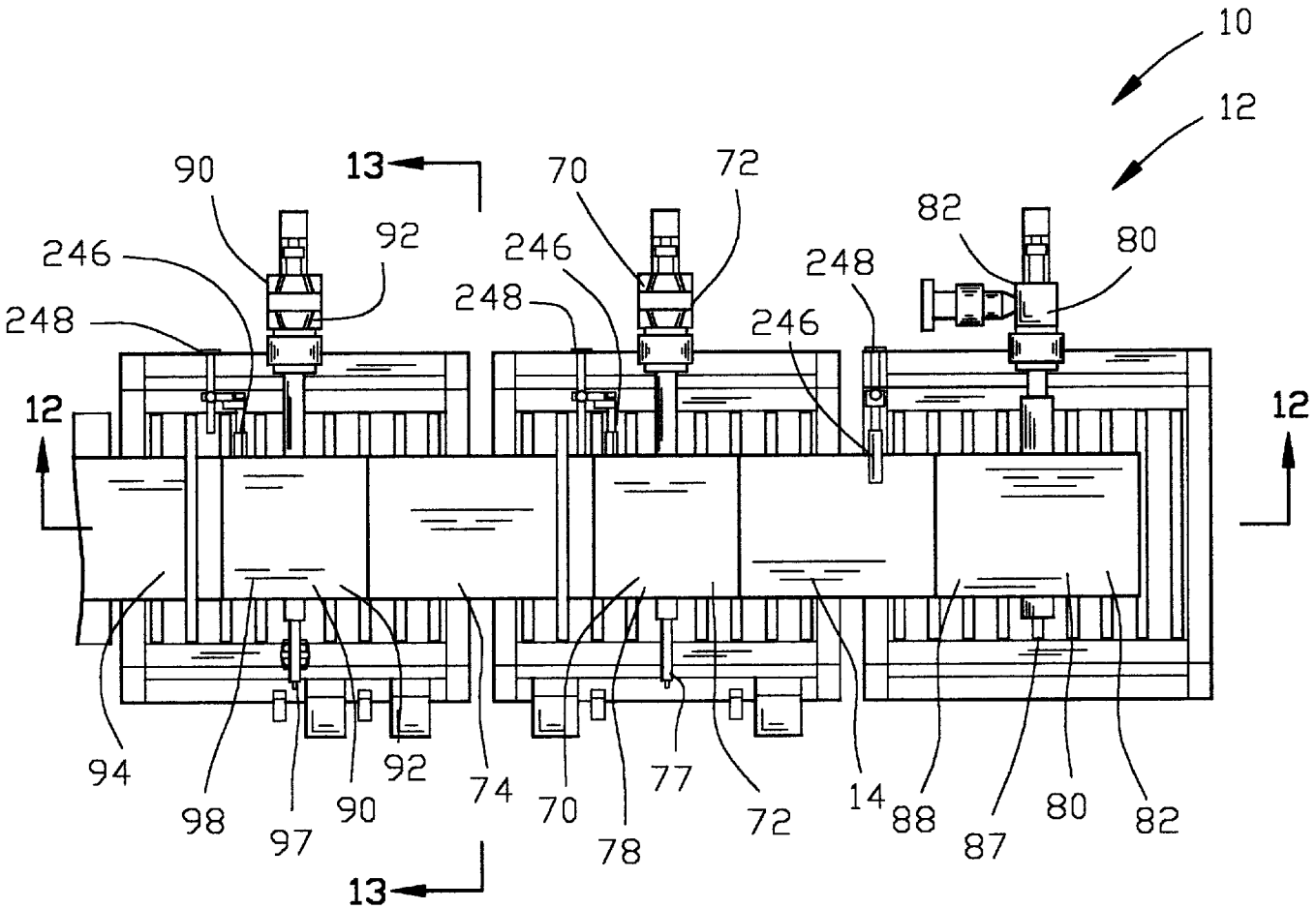
FIG. 11 is a top view of FIG. 10.

FIGS. 10 and 11 are enlarged side and top views of the output portion 12 of the apparatus 10 shown in FIGS. 1 and 2. The output portion 12 comprises a plurality of frames 221–223 located adjacent to the output drum 32 of the furnace conveyor 30. Each of the frames 221–223 are substantially identical to one another and are located in a serial arrangement relative to the output drum 32 of the furnace conveyor 30. Each of the frames 221–223 comprise a lower frame element 221A–223A and an upper frame element 221B–223B.

Each of the frames 221–223 comprise a first rail 230 cooperating with a first slide 232 for enabling each of the lower frame elements 221A–223A to independently laterally move as heretofore described. Each of the frames 221–223 comprise a second rail 240 cooperating with a second slide 242 for enabling each of the upper frame elements 221B–223B to independently laterally move relative to the lower frame elements 221A–223A.

Figure 12:
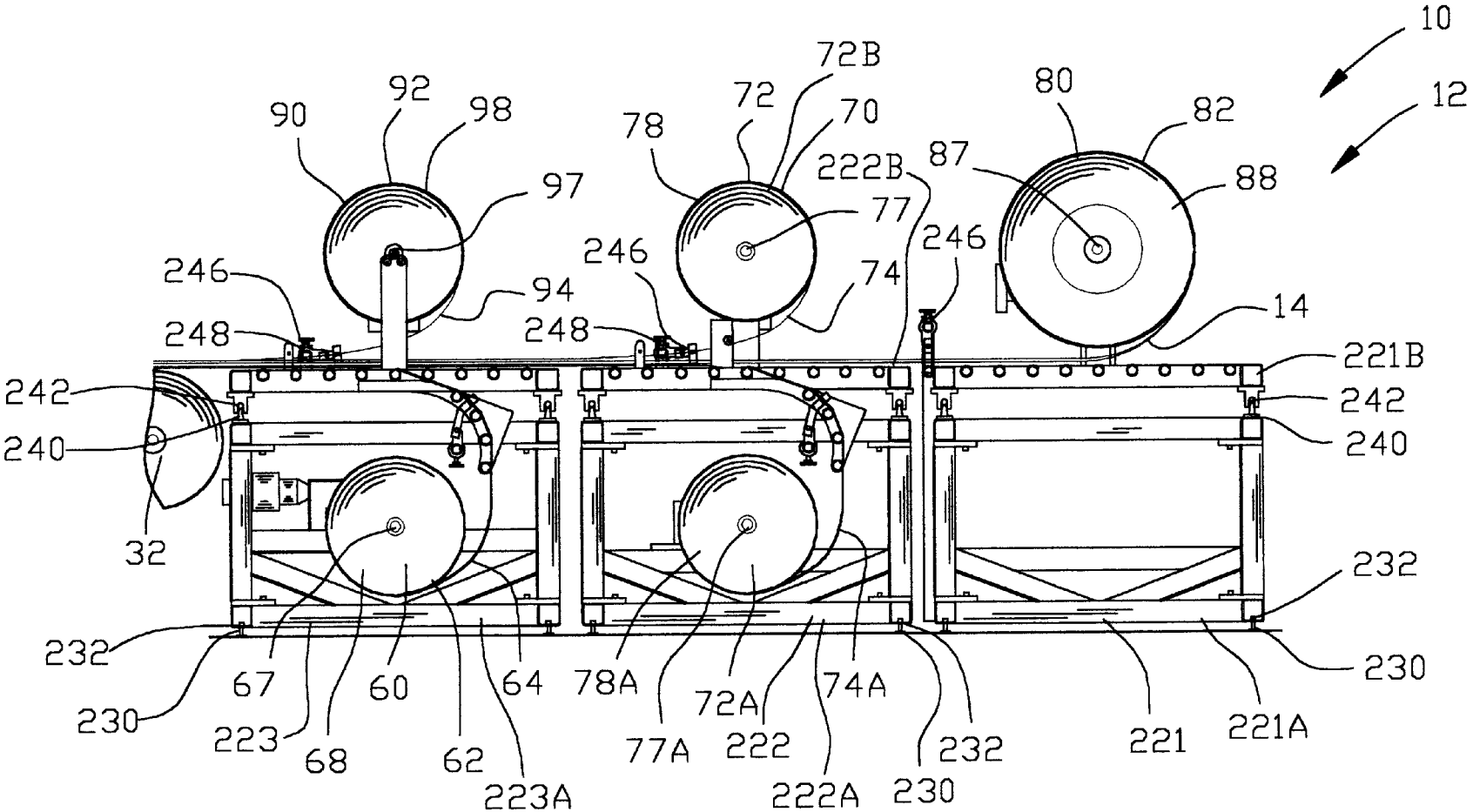
FIG. 12 is a sectional view along line 12—12 in FIG. 11.

FIG. 12 is a sectional view along line 12—12 in FIG. 11. The output barrier drive 62 is mounted to the lower frame element 223A for rolling the barrier material 64 onto the output barrier roll 66 from the furnace conveyor 34.

The output refractory drive 72 comprises a lower output refractory drive 72A and an upper refractory drive 72B. The lower output refractory drive 72A is mounted on the lower frame element 222A whereas the upper refractory drive 72B is mounted on the upper frame element 222B.

The lower and upper output refractory drives 72A and 72B roll the lower refractory material 74A onto the lower output refractory roll 76A and roll an upper refractory material 74B onto an upper output refractory roll 76B from the furnace conveyor 34.

The output web drive 82 is mounted on the upper frame element 221B. The output web drive 81 rolls the web material 14 onto the output web roll 86 from the furnace conveyor 34.

The output load drive 92 is mounted on the upper frame element 223B. The output load drive 92 rolls the load material 94 onto the output load roll 96 from on the furnace conveyor 34.

Figure 13:
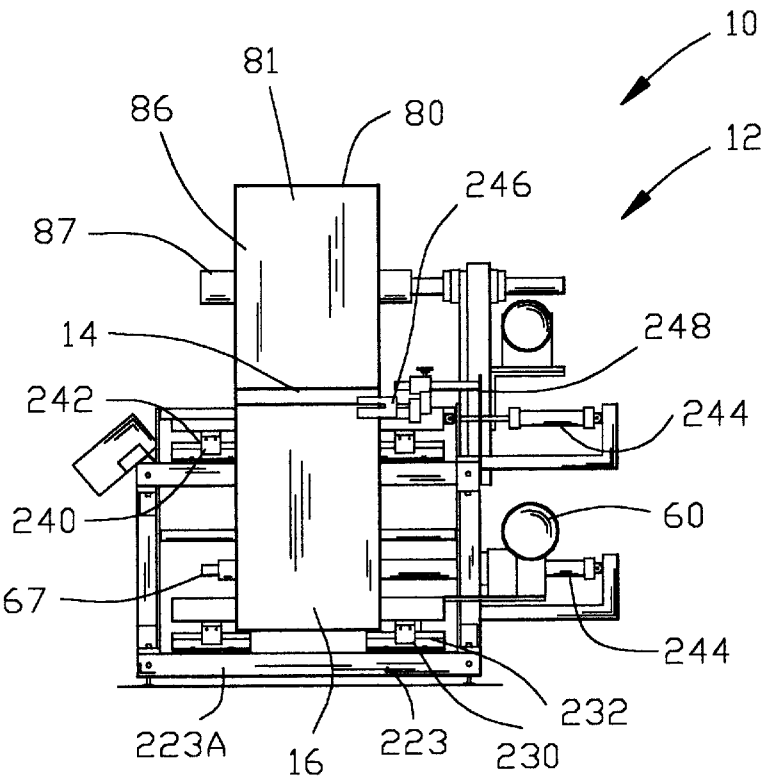
FIG. 13 is a sectional view along line 13—13 in FIG. 11.

FIG. 13 is a sectional view along line 13—13 in FIG. 11. Each of the lower frame elements 221A–223A include a first linear actuator 234 for laterally moving the drives along the first rail 230 and the first slide 232. Each of the upper frame elements 211B–223B include a second linear actuator 244 for laterally moving the drives along the second rail 240 and the second slide 242.

Each of the lower frame elements 221A–223A includes a first lateral sensor 236 for sensing the lateral position of the barrier material 64 and the lower refractory material 74A. The first lateral sensors 236 are connected to the first linear actuators 234 through the control 110 for actuating the first linear actuator 234.

Each of the upper frame elements 221B–223B includes a second lateral sensor 246 for sensing the lateral position of the web material 14, the upper refractory material 74B and the load material 94. The second lateral sensors 246 are connected to the second linear actuators 244 through the control 110 for actuating the second linear actuator 244.

Figure 14:
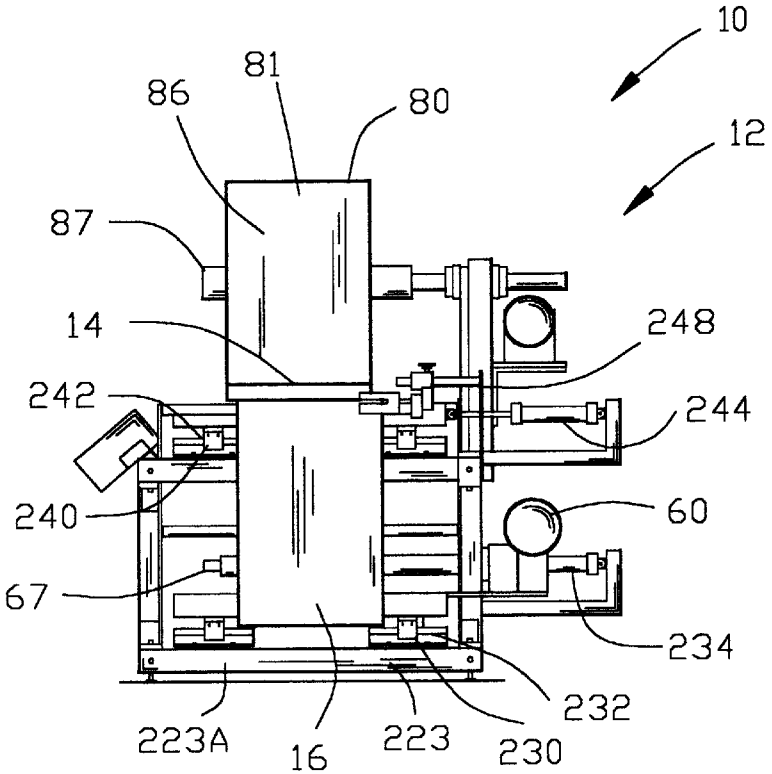
FIG. 14 is a view similar to FIG. 13 with an output drive being shown in a misaligned position.

FIG. 14 is a view similar to FIG. 13 with the load drive 90 being shown in a misaligned position. The second lateral sensor 246 senses the misalignment of the load material 94 and provides an output to the control 110 for actuating the respective second linear actuator 144 for moving the load drive 90 into proper alignment as shown in FIG. 13. Preferably, the lateral sensor 246 is similar to the lateral sensor 146 described heretofore.

During the operation of the present apparatus 10, the furnace conveyor 30 is actively driven at constant speed by the control 110. The barrier materials 64 and the lower refractory material 74 are placed on the furnace conveyor 30. The input barrier drive 61 and the lower input refractory drive 71A are brake clutch assemblies for providing a preestablished tensions to the barrier material 64 and the lower refractory material 74A.

The web material 14 is placed upon the lower refractory material 74A and is overlaid by the upper refractory material 74B and the load material 94. The upper input refractory drive 71 and the input load drive 91 are similar brake clutch assemblies for providing a preestablished tensions on the upper refractory material 74B and the load material 94.

In contrast, the web material drive 81 is an active drive for feeding the web material 14 between the lower and upper refractory materials 74A and 74B to maintain a minimum tension upon the web material 14.

The output drives including the output barrier drive 62, the output refractory drive 72, the output media drive 82 and the output load drive 92 are all active motor driven drives for producing a pre-established tension to the barrier material 64, the upper and lower refractory material 74A and 74B and the load material 64. In addition, the output web material drive 82 is similarly an active motor drive for rolling the sintered web material 14 onto the output web roll 86.

The present invention is suitable for use with an open matrix of metallic fibers 15. The open matrix of metallic fibers 15 has the strength and consistency of a web of cotton or wool. Accordingly the delicacy of the open matrix of metallic fibers 15 require the web materials to be prepared by hand. Typically, the metallic fibers 15 have a diameter of less than fifty microns and may have a diameter in the nanometer range. The open matrix of metallic fibers 15 is very delicate and is subject to tearing, stretching and the like. In many cases, the metallic fibers 15 are stainless steel fibers 15 having a diameter between five and thirty microns.

An important aspect of the present invention is the provisions for unrolling the web material 14 from the input web roll 86 onto the refractory material 74. The present invention enables the open matrix of the metallic fibers 15 to be processed by the present apparatus 10 without the tearing stretching or the like.

Figure 15:
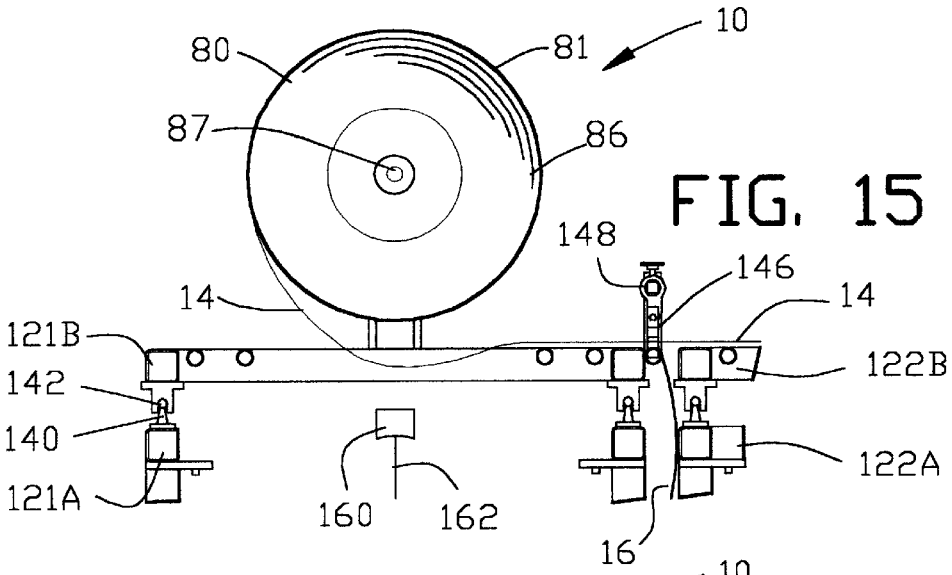
FIG. 15 is an enlarged view of a hanging sensor sensing a proper catenary hang of the web material from the input web roll.

FIG. 15 is an enlarged view of a hanging sensor 160 for sensing the hang of the web material 14 from the input web roll 86. The web material 14 hangs as a catenary between the web input roll 86 and a plurality of a rollers 170 disposed on the frame element 121B. Initially, the web material 14 is supported by the backing material 16 as heretofore described. The proper catenary hang of the web material 14 is the hang that will produce the minimum stress upon the web material 14.

FIG. 15 illustrates a proper catenary hang of the web material 14 that will produce the minimum stress upon the web material 14. The hanging sensor 160 is connected to the control 110 for driving the web drive 80 to be in unison with the movement of the refractory material 74 and the conveyor 30.

Figure 16:
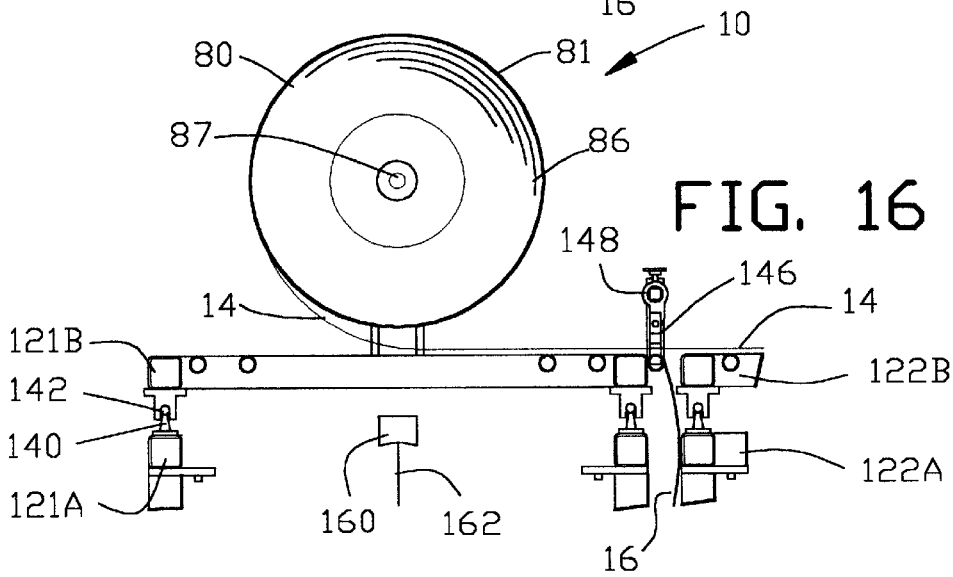
FIG. 16 is an enlarged view of the hanging sensor sensing a tight catenary hang of the web material from the input web roll.

FIG. 16 is an enlarged view of the hanging sensor 160 sensing a tight catenary hang of the web material 14 from the input web roll 86. Upon the hanging sensor 160 sensing a tight catenary hang of the web material 14, the hanging sensor 160 will provide a signal to the control 110 for increasing the speed of the web drive 80 to again produced the proper catenary Hang of the web material 14 as shown in FIG. 15.

Figure 17:
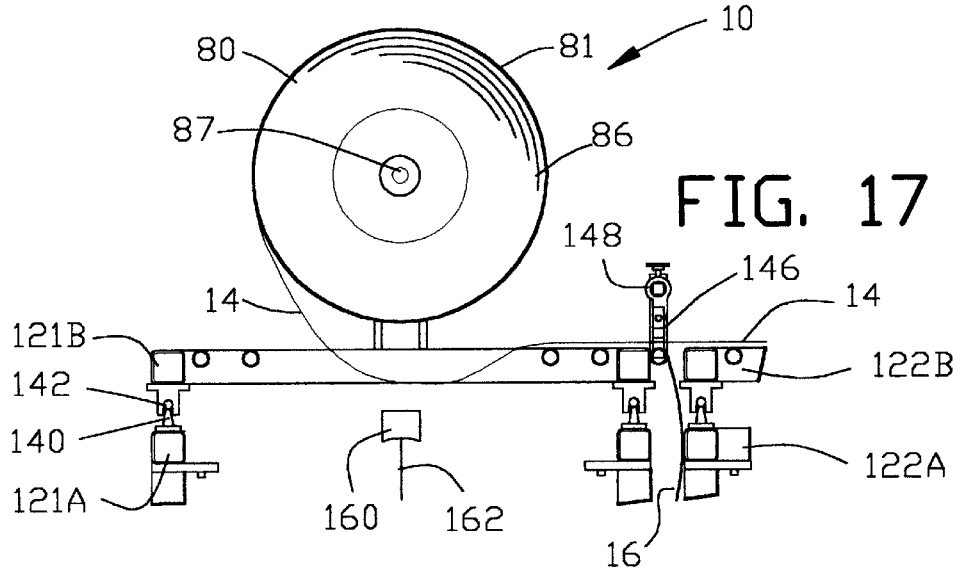
FIG. 17 is an enlarged view of the hanging sensor sensing a loose catenary hang of the web material from the input web roll.

FIG. 17 is an enlarged view of the hanging sensor 160 sensing a loose catenary hang of the web material 14 from the input web roll 86. Upon the hanging sensor 160 sensing a loose catenary hang of the web material 14, the hanging sensor 160 will provide a signal to the control 110 for decreasing the speed of the web drive 80 to again produced the proper catenary hang of the web material 14 as shown in FIG. 15.

Figure 18:
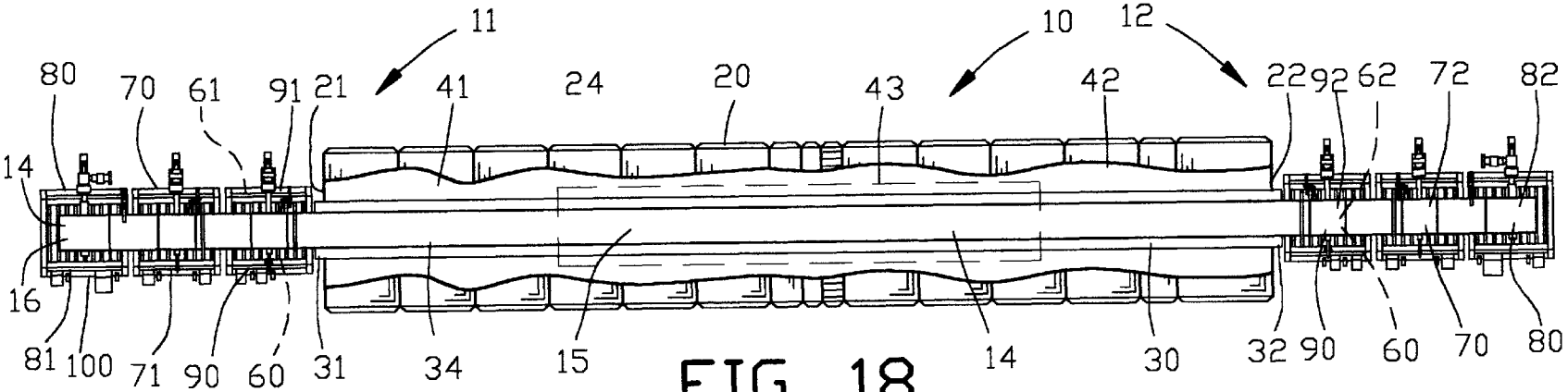
FIG. 18 PRIOR ART
FIG. 18 is a top cut away view of FIG. 2 illustrating a heated central zone of the apparatus for continuously sintering the web material incorporating the present invention.

FIG. 18 is a top cut away view of FIG. 2 illustrating the interior of the apparatus 10 for continuously sintering the web material incorporating the present invention. The sintering furnace 20 comprises the tunnel 24 extending between the open furnace input 21 and open furnace output 22. The sintering furnace 20 includes the input zone 41 and the output zone 42 with the central zone 143 disposed therebetween. The central zone 43 is raised to an elevated temperature suitable for sintering the selected web material 14.

The input and output zones 41 and 42 are maintained at a lower temperature relative to the heated central zone 43 for providing a region of temperature transition to and from the elevated temperature of the heated central zone 43. In the case when the web material 14 is an open matrix of stainless steel fibers 15, the web material 14 is sintered at approximately 1700 degrees Fahrenheit within a hydrogen atmosphere.

Figure 19:
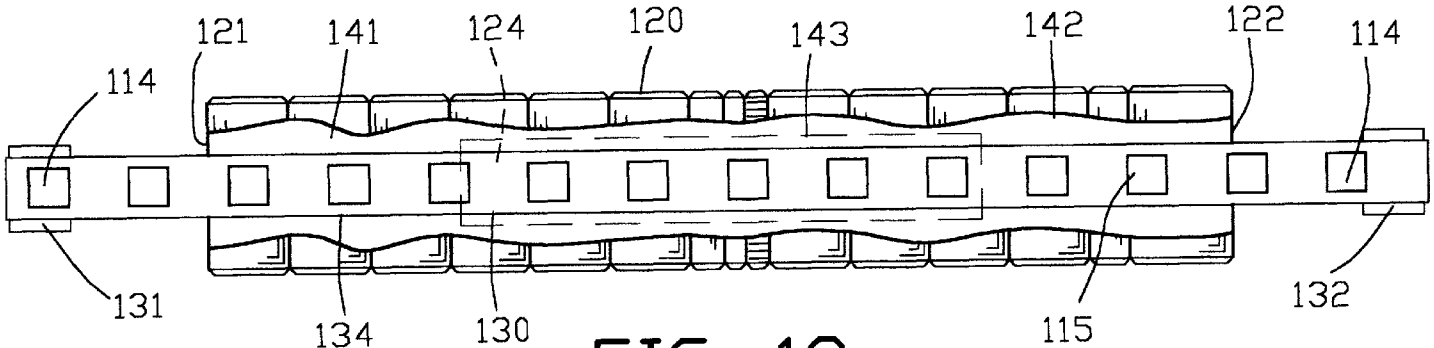
FIG. 19 is a top cut away view similar to FIG. 2 illustrating a heated central zone of a prior art sintering furnace for sintering a plurality of discrete web materials.

FIG. 19 is a top cut away view similar to FIG. 2 illustrating an interior of a prior art sintering furnace 120 for sintering a plurality of discrete web materials 114. The web material 114I comprises a matrix of metallic fibers 115. The prior art sintering furnace 120 comprises a tunnel 124 extending between the open furnace input 121 and open furnace output 122. A furnace conveyor 130 comprises an input drum 131 and output drum 132 with an endless belt 134 disposed therebetween. The input drum 131 and the output drum 132 are located adjacent to the open furnace input 121 and the open furnace output 122 with endless belt 134 extending through the sintering furnace 120. The furnace conveyor 130 continuously moves from the open furnace input 121 to the open furnace output 122.

The prior art sintering furnace 120 includes an input zone 141 and an output zone 142 with a heated central zone 143 disposed therebetween. The heated central zone 143 is raised to an elevated temperature suitable for sintering the selected web material 114. The input zone, the output zone and the central zone 141–143 of the prior art sintering furnace 120 have been shown identical to the input zone, output zone and central zone 41–43 of the sintering furnace 20 of the present invention shown in FIG. 18.

Figure 20:
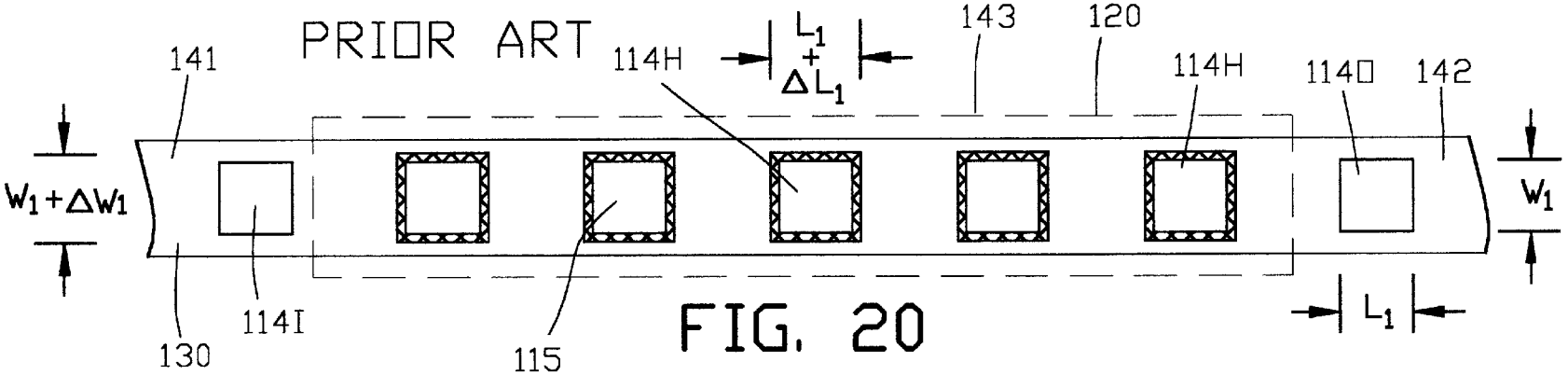
FIG. 20 is an enlarged view of the heated central zone of FIG. 19.

FIG. 20 is an enlarged view of the heated central zone 143 of FIG. 19. The plurality of discrete web materials 114 are disposed along the furnace conveyor 130. The web material 114I is located in the input zone 141 in an unsintered condition. The web material 114O is located in the output zone 142 in a sintered condition. The web material 114H are located in the central zone 143 undergoing the sintered process.

The unsintered web material 114I has a length of $L_1$ and a width of $W_1$. Similarly, the sintered web material 114O has a length of substantially $L_1$ and a width of substantially $W_1$. The length $L_1$ and the width $W_1$ of the unsintered web materials 114I are selected to have an aspect ratio (ratio of length to width) of under 2:1. The aspect ratio is selected to limit the magnitude of the length $L_1$ to minimize the amount of thermal expansion. Typically, the length $L_1$ of the unsintered web material 114I was kept under one meter.

When the web materials 114H are located within the heated central zone 143, the web materials 114H expand to have a length of $L_1+\Delta L_1$ and a width of $W_1+\Delta W_1$. The length expansion $\Delta L_1$ and width expansion $\Delta W_1$ is shown as a cross hatch in FIG. 20 and has been exaggerated for purposes of illustration.

Figure 21:
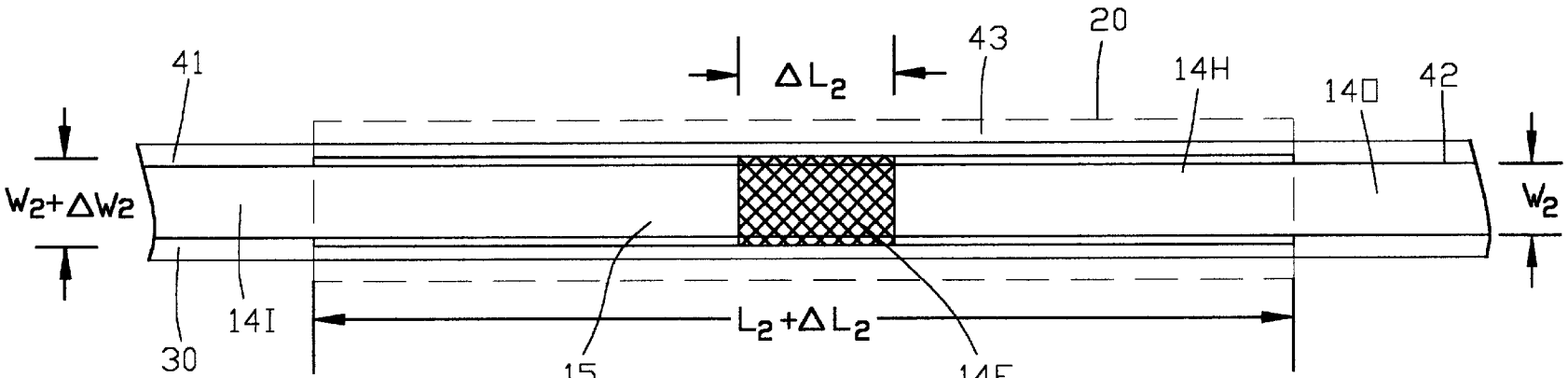
FIG. 21 is an enlarged view of the heated central zone of FIG. 18.

FIG. 21 is an enlarged view of the heated central zone 43 of FIG. 18. The continuous web material 14 is disposed along the furnace conveyor 30. A portion of the web material 14I is located in the input zone 41 in an unsintered condition. A portion of the web material 14O is located in the output zone 42 in a sintered condition. A portion of the web material 14H is located in the central zone 43 undergoing a sintered process.

The portion of the web material 14H located in the central zone 43 has an expanded length of $L_2+\Delta L_2$ and an expanded width of $W_2+\Delta W_2$. The aspect ratio of the expanded length $L_2+\Delta L_2$ to the expanded width of $W_2+\Delta W_2$ greatly exceeds the aspect ratio of 2:1.

Although the length expansion $\Delta L_2$ occurs along the entire unexpanded length $L_2$, the total effective length expansion $\Delta L_2$ and the total effective width expansion $\Delta W_2$ are shown as a cross hatch in FIG. 21. The length expansion $\Delta L_2$ and the width expansion $\Delta W_2$ are consistent with the exaggerated expansion of FIG. 20.

Figure 22:
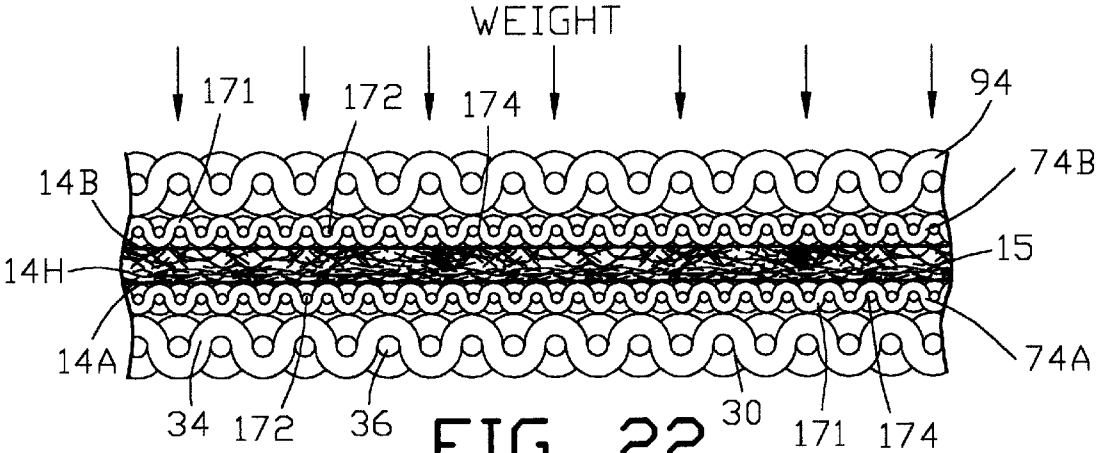
FIG. 22 is an expanded side view of FIG. 21 illustrating the web material interposed between refractory materials.

FIG. 22 is a magnified side view of the sintering of the web material 14H. The web material 14H is interposed between the lower and upper refractory materials 74A and 74B. The lower refractory material 74A rests upon the furnace conveyor 30 whereas the load material 94 provides a compressive load to the web material 14H.

The refractory materials 74A and 74B are elastic materials. The elastic refractory materials 74A and 74B undergo an expansion upon heating within the heated central region 43 of the furnace 20. When the elastic refractory materials 74A and 74B exits the heated central region 43 of the furnace 20, the elastic refractory materials 74A and 74B return to the original size and aspect ratio.

The refractory materials 74A and 74B are wire mesh cloth formed from weaving metallic wires. The wire mesh cloth comprises a warp 171 and a weave 172 with open voids 174 located between the warps and the weaves 171 and 172. The open voids 174 are necessary for the flow of heat to sinter the web material 14H.

The heat expansion and contraction of the wire mesh cloth of the refractory materials 74A and 74B is not equivalent to the heat expansion and contraction of a sheet of similar type material. The sinusoidal physical geometry of the warps 171 and the weaves 172 in combination with the open voids 174 provide unpredictable heat expansion of the refractory materials 74A and 74B.

Figure 23:
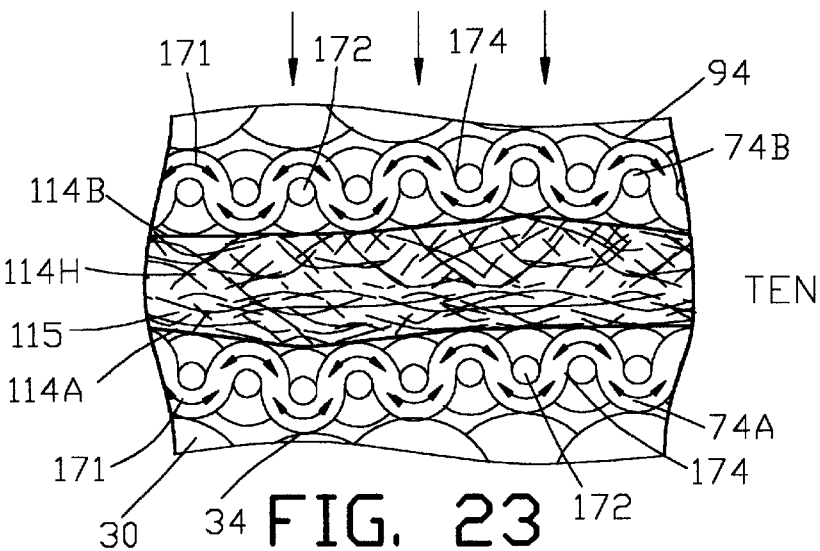
FIG. 23 is magnified view of a portion of FIG. 22 illustrating the web material being heated without tension on the refractory material.

FIG. 23 is a magnified view similar to FIG. 22 illustrating the heat expansion of the web material 114H and the refractory materials 74A and 74B within the prior art sintering furnace 120 shown in FIGS. 19 and 20. The directions of expansion of the warps 171 are shown by the arrows. The weaves 172 undergoes a similar type of expansion.

The refractory materials 74A and 74B are in intimate contact with a lower and an upper surface 114A and 114B of the web material 114H. The unsintered web material 114I comprises an open matrix of metallic fibers 115. Each of the metallic fibers 115 is not affixed to any adjacent fiber 115. Since the metallic fibers 115 are not affixed to adjacent fibers 115, the unsintered web material 114I is an inelastic web material 114I.

The sintered web material 114O comprises a sintered matrix of metallic fibers 115. Each of the metallic fibers 115 is affixed to adjacent fibers 115. Since the metallic fibers 115 are affixed to adjacent fibers 115, the sintered web material 114O is an elastic web material 114O.

During the sintering process, the web material 114H, begins as an unsintered inelastic web material 114I and is transformed into a sintered elastic web material 114O. During the sintering process, the web material 114 is subjected to expansion forces caused by the web material 114H as well as expansion forces caused by the unpredictable heat expansion of the refractory materials 74A and 74B. These unpredictable heat expansions of the refractory materials 74A and 74B are shown as the waves or ripples in the refractory materials 74A and 74B of FIG. 23.

During the initial heat expansion of the refractory materials 74A and 74B, the refractory materials 74A and 74B impart unpredictable expansion forces to the inelastic unsintered web material 114H. These unpredictable expansion forces deform the inelastic unsintered web material 114H prior to the complete sintering of the web material 114H.

These unpredictable expansion forces imparted to the web material 114H cease after the complete heat expansion of the refractory materials 74A and 74B. Unfortunately, the web material 114 has been deformed by the expansion forces caused by the unpredictable heat expansion of the refractory materials 74A and 74B.

Upon the completed sintering of the web material 114H, the deformations in the web material 114H caused by the unpredictable heat expansion of the refractory materials 74A and 74B are permanently imparted to the sintered web material 114H. The permanently imparted deformation within the sintered web material 114H are shown as the waves or ripples in the web 114H of FIG. 23.

Although this deformation problem was present in the prior art sintering furnace 120 shown in FIGS. 19 and 20, the deformation problem was minimized by limiting the length of $L_1$ and the width of $W_1$ of the unsintered web material 114H to under one meter. However, even with a length $L_1$ reduced to one meter, a deformation of the web material 114H appeared as a rippling of the sintered web material 114H around the perimeter of the web material 114H.

Figure 24:
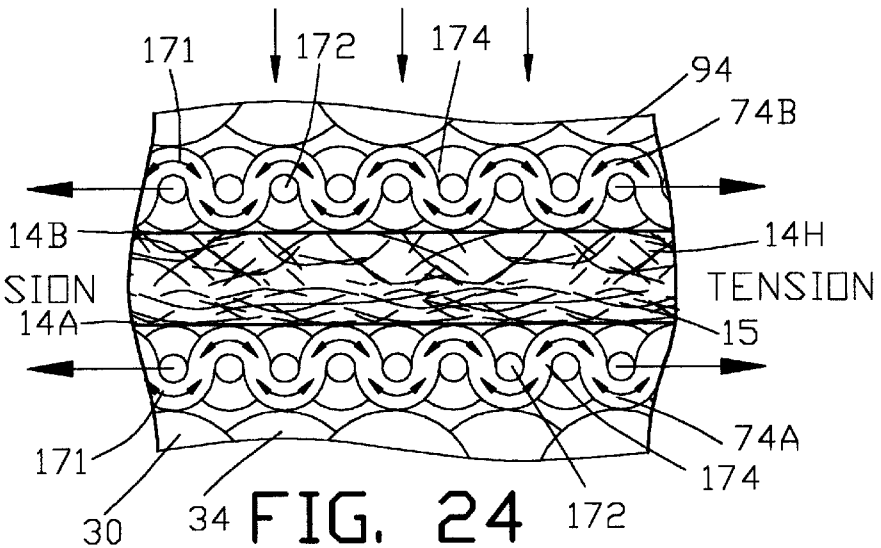
FIG. 24 is view similar to FIG. 23 illustrating the web material being heated with tension on the refractory material.

FIG. 24 is a magnified view similar to FIG. 22 illustrating the heat expansion of the web material 14H and the refractory materials 74A and 74B within the sintering furnace 20 of the present invention shown in FIGS. 18 and 21. The web material 14H is being heated with tension being applied to the refractory materials 74A and 74B. The tensions applied to the opposed ends of the lower and upper refractory materials 74A and 74B are indicated by the arrows in FIG. 24.

The application of tensions to opposed ends of the refractory materials 74A and 74B appear to minimize any deformations in the web material 14H caused by the heat expansion of the refractory materials 74A and 74B. The waves in the web material 114H shown in FIG. 23 are not encountered in FIG. 24 when the refractory materials 74A and 74B are subjected to a tension.

Although the theory of the above mechanism is not completely understood, it is speculated that the tension disperses unpredictable heat expansion generated in a localized area into predictable heat expansion applied over the entire area of expansion. In any event, the tension applied to the refractory materials 74A and 74B overcomes the problems of the prior art and enables the web material 14 to be made in unlimited lengths.

The present invention overcomes the deformation of the web material 14H by adding a tensions to the opposed ends of the lower and upper refractory materials 74A and 74B. The tensions are applied in opposed direction substantially parallel to the length $L_2$ of the web material 114H. The tensions applied to the lower and upper refractory materials 74A and 74B permit the maximum length $L_2$ of the web material 14 to be virtually any length. Stainless steel web material 14 have been made successfully with an apparatus having a heated central zone 43 extending approximately twenty meters.

The present invention provides an improved apparatus and method of continuously sintering a web material 14 with a sintering furnace 20 which may accommodate web material of extended lengths. The improved apparatus and method may be used with delicate web material such as a matrix of fine metallic fibers. Furthermore, a single sheet of fibrous material may be sintered with meaningful, economical results.

The improved apparatus and method eliminates the need to hand assemble the stack of sheets of fibrous media and produces more consistent characteristics then provided by the sintering furnaces of the prior art in a more efficient manner and at a reduced cost.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for continuously sintering a web of media material with a sintering furnace, the sintering furnace having a furnace conveyor moving from a furnace input to a furnace output, comprising:

a lower input refractory driver for unrolling a lower refractory material from an input refractory roll and feeding said refractory material to be disposed upon the furnace conveyor in proximity to the furnace input of the furnace;

a lower output refractory driver for rolling said lower refractory material onto an output refractory roll from the furnace conveyor in proximity to the furnace output of the furnace;

an input media drive for unrolling the media material from an input media roll and feeding said media material onto said lower refractory material;

an output media drive for removing said media material from said lower refractory material and for rolling the media material onto an output media roll;

an upper input refractory driver for unrolling an upper refractory material from an input refractory roll and feeding said refractory material to be disposed upon the media material disposed upon said lower refractory material in proximity to the furnace input of the furnace;

an upper output refractory driver for rolling said upper refractory material onto an output refractory roll from said media material in proximity to the furnace output of the furnace;

said upper refractory material providing a compressive force to said media material within the furnace; and a tension device cooperating with said upper and lower input refractory drivers for applying a tension acting upon opposed ends of said lower and upper refractory materials for maintaining a constant tension therebetween for maintaining a constant force on said upper and lower surfaces of said media material.

2. An apparatus for continuously sintering a web of media material with a sintering furnace as set forth in claim 1, wherein the furnace conveyor is an endless belt conveyor disposed within a furnace and extending between the open furnace input and the open furnace output.

3. An apparatus for continuously sintering a web of media material with a sintering furnace as set forth in claim 1, wherein the furnace comprises an open furnace input and an open furnace output; and the furnace conveyor comprising an endless belt conveyor disposed within the furnace and extending between the open furnace input and the open furnace output.

4. An apparatus for continuously sintering a web of media material with a sintering furnace as set forth in claim 1, including an input load drive for unrolling a load material from an input load roll and feeding said load material onto said upper refractory material for providing a load upon said media material; and an output load drive for removing said load material from said upper refractory material and for rolling said load material onto an output load roll.

5. An apparatus for continuously sintering a web of media material with a sintering furnace as set forth in claim 1, including a lateral sensor for adjusting the lateral position of said input and output refractory drives relative to the furnace conveyor.

6. An apparatus for continuously sintering a web of media material with a sintering furnace as set forth in claim 1, including an input barrier drive for unrolling a barrier material from an input barrier roll and feeding said barrier material onto the furnace conveyor for providing a support to said lower refractory material; and an output barrier drive for removing said barrier material from the furnace conveyor and for rolling said barrier material onto an output barrier roll.

7. An apparatus for continuously sintering a web of media material with a sintering furnace, the sintering furnace having a furnace conveyor moving from a furnace input to a furnace output, comprising:

a lower input refractory driver for unrolling a lower refractory material from an input refractory roll and feeding said refractory material to be disposed upon the furnace conveyor in proximity to the furnace input of the furnace;

a lower output refractory driver for rolling said lower refractory material onto an output refractory roll from the furnace conveyor in proximity to the furnace output of the furnace;

an input media drive for unrolling the media material from an input media roll and feeding said media material onto said lower refractory material;

an output media drive for removing said media material from said lower refractory material and for rolling the media material onto an output media roll;

an upper input refractory driver for unrolling an upper refractory material from an input refractory roll and feeding said refractory material to be disposed upon the media material disposed upon said lower refractory material in proximity to the furnace input of the furnace;

an upper output refractory driver for rolling said upper refractory material onto an output refractory roll from said media material in proximity to the furnace output of the furnace;

said upper refractory material providing a compressive force to said media material within the furnace;

a hanging sensor for sensing a catenary hang of said media material from said input media roll;

a control connected to said hanging sensor for powering said input media drive for unrolling the media materials in unison with the movement of the furnace conveyor and said lower and upper refractory materials for maintaining a constant catenary hang of said media material from said input media roll; and a tension device cooperating with said upper and lower input refractory drivers for applying a tension acting upon opposed ends of said lower and upper refractory materials for maintaining a constant tension therebetween for maintaining a constant force on said upper and lower surfaces of said media material.

8. An apparatus for continuously sintering a web of media material with a sintering furnace as set forth in claim 7, wherein the furnace conveyor is an endless belt conveyor disposed within a furnace and extending between the open furnace input and the open furnace output.

9. An apparatus for continuously sintering a web of media material with a sintering furnace as set forth in claim 7, wherein said hanging sensor includes a proximity sensor for remotely sensing the hang of the media material.

10. An apparatus for continuously sintering a web of media material with a sintering furnace as set forth in claim 7, wherein the hanging sensor includes a proximity sensor for remotely sensing the hang of the media material; and said control powering said input media drive for unrolling the media material from an input media roll and feeding said media material onto said lower refractory material for maintaining a predetermined desired hang of the matrix of open metallic fibers between the cylinder and the conveyor.

11. An apparatus for continuously sintering a web of media material with a sintering furnace as set forth in claim 7, wherein said hanging sensor sensing the catenary hang of the media material; and said hanging sensor connected to said control for controlling said input media drive for maintaining a constant catenary hang of said media material between said input media roll and said refractory material.

12. An apparatus for continuously sintering a web of media material with a sintering furnace as set forth in claim 7, wherein the furnace comprises an open furnace input and an open furnace output; and the furnace conveyor comprising an endless belt conveyor disposed within the furnace and extending between the open furnace input and the open furnace output.

13. An apparatus for continuously sintering a web of media material with a sintering furnace as set forth in claim 7, including an input load drive for unrolling a load material from an input load roll and feeding said load material onto said upper refractory material for providing a load upon said media material; and an output load drive for removing said load material from said upper refractory material and for rolling said load material onto an output load roll.

14. An apparatus for continuously sintering a web of media material with a sintering furnace as set forth in claim 7, including a lateral sensor for adjusting the lateral position of said input and output refractory drives relative to the furnace conveyor.

15. An apparatus for continuously sintering a web of media material with a sintering furnace as set forth in claim 7, including an input barrier drive for unrolling a barrier material from an input barrier roll and feeding said barrier material onto the furnace conveyor for providing a support to said lower refractory material; and an output barrier drive for removing said barrier material from the furnace conveyor and for rolling said barrier material onto an output barrier roll.

* * * * *